US012742264B2

(12) United States Patent
Rhyne et al.

(10) Patent No.: US 12,742,264 B2
(45) **Date of Patent: *Sep. 22, 2026**

(54) AUTOMATED YARN PACKAGE HANDLING SYSTEM AND METHOD

(71) Applicant: Belmont Textile Machinery Company, Mount Holly, NC (US)

(72) Inventors: Jeffrey Todd Rhyne, Mount Holly, NC (US); Donald Alan Pubentz, Mount Holly, NC (US)

(73) Assignee: Belmont Textile Machinery Company, Mount Holly, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/897,880

(22) Filed: Sep. 26, 2024

(65) Prior Publication Data

US 2025/0019868 A1 Jan. 16, 2025

Related U.S. Application Data

(63) Continuation of application No. 17/545,581, filed on Dec. 8, 2021, now Pat. No. 12,129,576.

(Continued)

(51) Int. Cl.
*D01H 9/18* (2006.01)
*B65H 63/00* (2006.01)

(Continued)

(52) U.S. Cl.
CPC ..... *D01H 9/18* (2013.01); *B65H 63/006* (2013.01); *B65H 65/005* (2013.01);

(Continued)

(58) Field of Classification Search
CPC .. B65H 63/005; B65H 65/005; B65H 67/063; B65H 67/065; B65H 67/066; D01H 9/18; D01H 13/12; D01H 13/32
See application file for complete search history.

(56) References Cited

U.S. PATENT DOCUMENTS 4,615,493 A * 10/1986 Teranishi ..... B65H 67/0405 242/473.7
4,753,463 A * 6/1988 Strosser ..... A01F 15/148 100/41

(Continued)

FOREIGN PATENT DOCUMENTS

CN 111498610 A 8/2020
EP 0 069 708 B1 1/1983

(Continued)

OTHER PUBLICATIONS

International Search Report and Written Opinion issued on Aug. 31, 2022, in corresponding International Application No. PCT/US2022/075736 (11 pages).

(Continued)

*Primary Examiner* — Bao-Thieu L Nguyen
(74) *Attorney, Agent, or Firm* — Shumaker, Loop & Kendrick, LLP; S. Alexander Long, Jr.

(57) ABSTRACT

An apparatus and method of robotically tying a knot that includes the steps of removing the package from the elevator tray to a knotting head apparatus at the knot-tying location where a knot is tied in a yarn tail of the package to secure the package tail from unraveling in subsequent package handling steps. Correct application of the knot to the yarn tail is either validated, or in the alternative, if the knot is not validated, the package is forwarded to a location for manual reworking to apply a correct knot to the yarn tail.

20 Claims, 17 Drawing Sheets

Related U.S. Application Data

(60) Provisional application No. 63/244,904, filed on Sep. 16, 2021.

(51) Int. Cl.
*B65H 65/00* (2006.01)
*D01H 13/12* (2006.01)
*D01H 13/32* (2006.01)

(52) U.S. Cl.
CPC ..... *D01H 13/12* (2013.01); *D01H 13/32* (2013.01); *B65H 2553/21* (2013.01); *B65H 2553/42* (2013.01)

(56) References Cited

U.S. PATENT DOCUMENTS 4,765,235 A * 8/1988 Schrag ..... B65H 69/00 100/3
4,988,252 A * 1/1991 Yamamoto ..... D02H 1/00 414/346
5,000,231 A * 3/1991 Takehana ..... D03D 47/34 242/474.2
5,082,192 A * 1/1992 Langen ..... B65H 67/065 198/465.4
5,192,032 A * 3/1993 Brouwer ..... B65H 54/20 242/413.3
5,211,000 A * 5/1993 Fink ..... B65H 67/064 57/90
5,277,293 A * 1/1994 Nakanishi ..... B65H 67/065 198/409
6,250,059 B1 * 6/2001 Teich ..... B65H 67/064 53/430
6,260,783 B1 * 7/2001 Realff ..... B65H 67/063 294/98.1
6,276,628 B1 * 8/2001 Focke ..... B21C 47/242 414/427
6,419,283 B1 * 7/2002 Thomas ..... B65H 69/04 289/1.5
6,633,383 B1 * 10/2003 Jackson ..... G01N 21/8915 356/238.2
6,641,181 B2 * 11/2003 Thomas ..... B65H 69/04 289/1.5
12,129,576 B2 * 10/2024 Rhyne ..... D01H 13/32
2002/0060455 A1 * 5/2002 Thomas ..... B65H 69/04 289/2
2002/0171245 A1 * 11/2002 Thomas ..... B65H 69/04 289/3
2021/0039908 A1 * 2/2021 Bertolucci ..... B65H 19/2269
2021/0304638 A1 * 9/2021 Mottrie ..... B25J 9/1679
2021/0404094 A1 * 12/2021 Zhang ..... D01H 9/001
2023/0089801 A1 * 3/2023 Schuler ..... B65H 69/04 289/1.5
2023/0114121 A1 * 4/2023 Massotte ..... B65H 65/005 242/475.7
2024/0355219 A1 * 10/2024 Vincent ..... G09B 9/00
2025/0217265 A1 * 7/2025 Hicks ..... G06N 3/08

FOREIGN PATENT DOCUMENTS

EP 0 340 397 B1 11/1989
EP 1 112 954 B1 7/2001
JP 07113752 A 5/1995
JP 07133078 A 5/1995
WO 2020188452 A1 9/2020

OTHER PUBLICATIONS

International Preliminary Report on Patentability issued on Mar. 5, 2024, in corresponding International Application No. PCT/US2022/075736 (8 pages).
European Search Report issued on Apr. 24, 2025, in corresponding European Application No. 22870888, filed on Aug. 31, 2022 (14 pages).

* cited by examiner

AUTOMATED YARN PACKAGE HANDLING SYSTEM AND METHOD

PRIORITY CLAIM

This is a continuation application tracing priority to co-pending U.S. patent application Ser. No. 17/545,581 filed on Dec. 8, 2021, entitled Automated Yarn Package Handling System and Method, which claims priority benefit of U.S. Provisional Patent Application No. 63/244,904, filed on Sep. 16, 2021, and entitled Automated Yarn Package Handling System and Method, the entire contents of each of which are hereby expressly incorporated herein by reference.

TECHNICAL FIELD AND BACKGROUND OF INVENTION

This invention relates to an automatic yarn package handling system and a related method of efficiently handling yarn packages with a minimum of labor. The system incorporates yarn package knot tying technology owned by applicant and disclosed and claimed in U.S. Pat. Nos. 6,419,283 and 6,641,181. One application for the machine is in various textile or other strand producing processes, hereinafter referred to as "textile" processes. The apparatus ties a slip knot in a single textile strand. Many textile machines, for example, spinning frames, winders and the like employ automated machines to tie two yarn ends together. This often happens when supply packages are exchanged. In effect, tying the two ends together permits the process to continue as if the yarn were a single continuous strand instead of two end-to-end strands connected together with a knot. As is apparent, the principal criteria for such a knot-tying machine is to quickly tie a knot which will not come untied and which is sufficiently strong to withstand the various stresses and tensions placed on the yarn during downstream processing.

The knot-tying part of this invention is distinctly different from machines and processes which tie together yarns or other strand material ("yarn") end-to-end. Rather, a slip-knot is tied in the single free end of yarn on, for example, the outer surface of a wound package of yarn. The purpose of the knot is to prevent the package from beginning to unwind during doffing, transportation, storage and donning onto downstream machines. The slip-knot is easily untied simply by pulling the free end of the yarn.

Most prior art methods of preventing yarn from unwinding from a package involve using a short length of tape to adhere the free end to the outer surface of the package, or catching the yarn in a notch or slit in the end of the tube on which the yarn is wound.

In another prior art method, the free end of yarn is doubled and then forced through the edge of the outer surface of yarn by a long needle, so that some of the outermost wraps of yarn hold the doubled length of yarn in place. The end is freed by pulling on the free end. This process presents the possibility of damage to the yarn by the needle or tangling of the doubled yarn, particularly if it is pushed too far into the package.

There exists a need to further integrate automated knot tying into an overall textile process. By way of example in this application, a yarn package knotter is disclosed as part of an automated textile yarn winder and includes advanced techniques for quickly and accurately determining whether the required knot has been correctly tied and directing the yarn package further along in the automated process or diverting the package to a manual area for reworking.

The principles of the invention disclosed in this application have applications with regard to multiple types of yarn packages, including yarn applied to cones, tubes, solid core and tubular core, among others now known or developed in the future.

SUMMARY OF THE INVENTION

More specifically, the yarn package knotter is disclosed in this application as part of a servo- and PLC-controlled unit that automatically collects finished yarn packages from a winder at a plurality of, for example, three winder conveyors. Once a finished yarn package has been identified as presented for collection, that package is received into the knotting system and oriented through translational and rotational motions resulting in placement of that package at the loading position of an indexing conveyor in a preferred orientation for further processing. The knotting process consists of tying the loose end of the yarn package, and applying an identifying label to the package. The knotting and labeling actions are performed within the system via the indexing conveyor, which sequentially positions the package at a plurality of positions for which each position is dedicated to a single processing action. The knotting and labeling actions are not dependent upon each other for the purpose of determining the order within the system in which these actions are performed upon the package. Upon completion of the final process action, the package is moved to the discharge position of the indexing conveyor. From the discharge position, the package is detected and moved via automated motions (e.g. a collaborative robot) to a defined case packing matrix. This process is repeated until an entire winder doff of yarn packages have been removed from the winder.

The package knotter is integrated with the indexing conveyor at the knotting position. The knotting position features a pneumatically actuated spindle that is driven by an individual servo motor which allows the yarn package to rotate during the knot tying process. Coordinated with the servo rotation of the yarn package is the servo rotation of the gripper around the yarn package with the tail end of the yarn package. Combined with several pneumatic motions, this unit ties a slip knot with the tail end of the yarn package which allows easy removal of the knot at tufting. Labels are supplied via a label printer. The printed labels are picked up from the printer by the pneumatic label applicator and in the case of tubular packages, transferred to an inside surface of the yarn package tube prior to the package knotting process.

According to one aspect of the invention, a method of automatically moving yarn packages between yarn processing stations m a textile environment includes the steps of providing a yarn package elevator, transporting a yarn package on the yarn package elevator from a textile machine position to a common transfer location, holding the package in a stationary position on a package transporter, applying a label to a surface of the package, moving the package to a knot-tying location, removing the package from the package transporter to a robotic knotting head apparatus at the knot-tying location, robotically tying a knot to a package yarn tail of the package to secure the package tail from unraveling in subsequent package handling, and robotically validating correct application of the knot to the yarn tail.

According to another aspect of the invention, the step of validating correct application of the knot to the yarn tail includes the step of monitoring torque applied to the yarn.

According to another aspect of the invention, the step of validating correct application of the knot to the yarn tail includes the step of sensing a strain value on the yarn tail indicating that the yarn end is loose, rather than being held in the knot.

According to another aspect of the invention, the step of validating correct application of the knot to the yarn tail includes the step of sensing the presence or absence of the knot in the yarn by utilizing a sensing device selected from the group consisting of a strain gauge and a load cell.

According to another aspect of the invention, the step of validating correct application of the knot to the yarn tail includes the steps of visually inspecting the surface of the yarn package to determine the presence or absence of the knot by capturing an image of the package surface and comparing the image of the package surface against a digital store of images representing the yarn arrangement indicative of a correctly-tied knot.

According to another aspect of the invention, the step of validating correct application of the knot to the yarn tail includes the steps of visually inspecting the surface of the yarn package to determine the presence or absence of the knot by digitally capturing an image of the package surface and comparing the image of the package surface against a digital store of images representing the yarn arrangement indicative of a correctly-tied knot.

According to another aspect of the invention, the step of validating correct application of the knot to the yarn tail includes the steps of applying a source of energy to the surface of the package to detect, measure and compare a returned energy signal against a digital data store of surface irregularities on the package indicative of the presence or absence of a knot.

According to another aspect of the invention, the step of validating correct application of the knot to the yarn tail includes the step of sensing the presence or absence of the knot in the yarn by utilizing an energy source selected from the group consisting of a laser and ultrasound.

According to another aspect of the invention, the knot is validated as correctly applied, forwarding the package to a case building location or, if the knot is not validated, forwarding the package to a location for applying a correct knot to the yarn tail.

According to another aspect of the invention, an apparatus is provided for automatically moving yarn packages between yarn processing stations in a textile environment, and includes a yarn package transporter for transporting a yarn package from a textile machine position to a common transfer location, a package holder for holding the yarn package in a stationary position while an identifying label is applied to a surface of the yarn package, the yarn package transporter adapted to move the yarn package to a knot-tying location, a knotting head apparatus at the knot-tying location for tying a knot to a yarn tail of the yarn package to secure the yarn tail from unraveling in subsequent yarn package handling, and a digitally-controlled knot-validating apparatus for validating correct application of the knot to the yarn tail.

According to another aspect of the invention, the knot-validating apparatus comprises an apparatus for monitoring torque to the yarn indicating that the yarn end is loose, rather than being held in the knot.

According to another aspect of the invention, the knot-validating apparatus includes an apparatus for sensing a strain value on the yarn tail indicating that the yarn end is loose, rather than being held in the knot.

According to another aspect of the invention, the knot-validating apparatus is adapted for sensing the presence or absence of the knot in the yarn and is selected from the group consisting of a strain gauge and a load cell.

According to another aspect of the invention, the knot-validating apparatus includes a visual inspecting apparatus adapted to inspect the surface of the yarn package to determine the presence or absence of the knot by capturing an image of the package surface and comparing the image of the package surface against a digital store of images representing the yarn arrangement indicative of a correctly-tied knot.

According to another aspect of the invention, the knot-validating apparatus includes a source of energy adapted to apply energy to the surface of the package to detect, measure and compare a returned energy signal against a digital data store of surface irregularities on the package indicative of the presence or absence of a knot.

According to another aspect of the invention, the energy source is selected from the group consisting of a laser and ultrasound.

According to another aspect of the invention, a yarn package indexer is provided, wherein if the knot is validated as correctly applied, the yarn package indexer forwards the package to a case building location or, if the knot is not validated, the yarn package indexer forwards the package to a location for applying a correct knot to the yarn tail.

According to another aspect of the invention, the yarn package indexer includes an indexing conveyor including a rotatable discharge station pad for rotating the yarn package to the case building location or, if the knot is not validated, the yarn package indexer is adapted to forward the package to the location for applying a correct knot to the yarn tail.

According to another aspect of the invention, the rotatable discharge station pad includes a pivoting actuator adapted for tipping the yarn package in a desired direction onto a work surface for further processing of the yarn package.

According to another aspect of the invention, a discharge conveyor defining a common location for interfacing with one or more automation apparatuses is adapted to selectively transport a yarn package to a package case building location in the event of a correctly knotted yarn package, or to a knot-tying location for manual application of a knot to the yarn package in the event of an incorrectly knotted package.

DESCRIPTION OF THE PREFERRED EMBODIMENT AND THE BEST MODE

Figure 1:
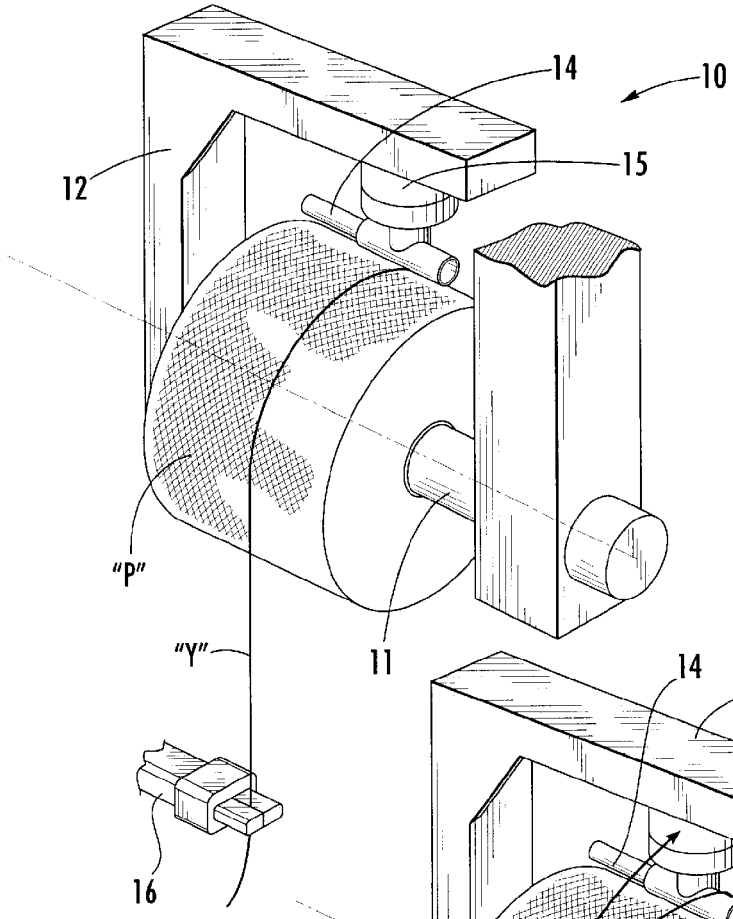
FIGS. 1-10 are sequential views of an automatic slip-knot tying machine according to one embodiment of the invention.
Figure 2:
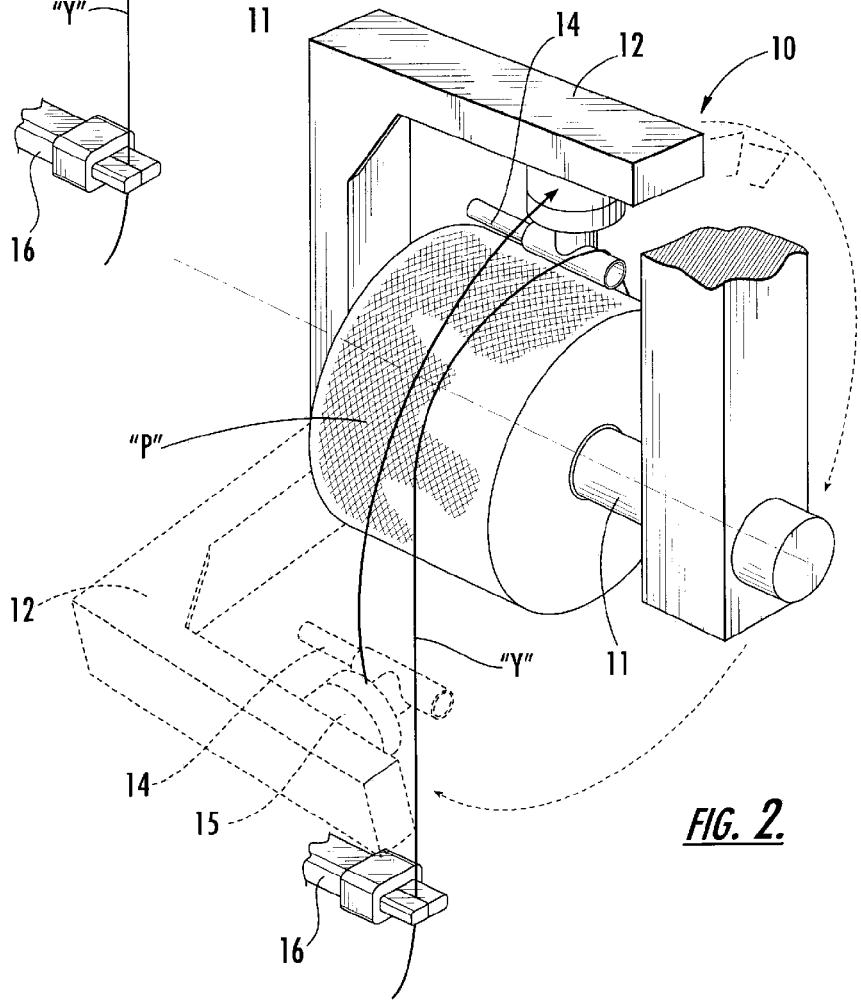

Referring now specifically to the drawings, an automatic knot-tying machine according to one embodiment of the present invention is illustrated in FIGS. 1-10 and shown generally at reference numeral 10. It is anticipated that automatic knot-tying machine 10 will be an attachment to textile winders and other machines where such knots are useful in preparing packages of yarn for transport to downstream processes. In one type of textile winder, packages are doffed from the individual winding stations and carried by a conveyer to one end of the machine, where the automatic knot-tying machine 10 finds the free end of the yarn "Y" and ties it into a slip knot in accordance with the invention disclosed herein.

The automatic knot-tying machine 10 includes a mandrel 11 on which the yarn package "P" is positioned. A swing arm 12 is positioned to rotate around the package "P", and carries a loop-forming tube 14. The mandrel 11 remains stationary. A gripper 16 holds the free end of the yarn "Y" taut during knot formation. From the starting position shown in FIG. 1, the swing arm 12 rotates around the package "P" and in so doing catches the yarn "Y" on the loop-forming tube 14. The loop-forming tube 14 is mounted for rotation around a vertical axis on a shaft 15.

When the swing arm reaches the twelve o'clock position again (FIG. 2), the yarn "Y" is looped around the package "P" and rests over the loop-forming tube 14. Yarn to form the loop is unwound off of the package "P" during rotation of the swing arm 12.

Figure 3:
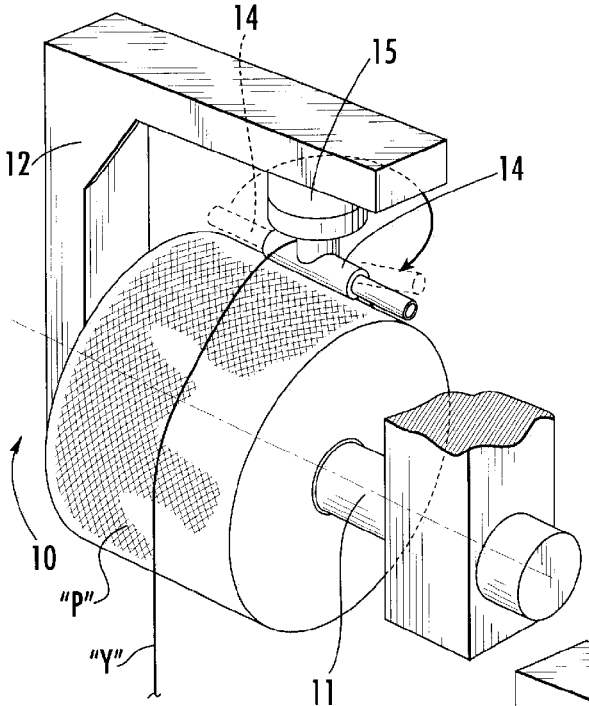
Figure 4:
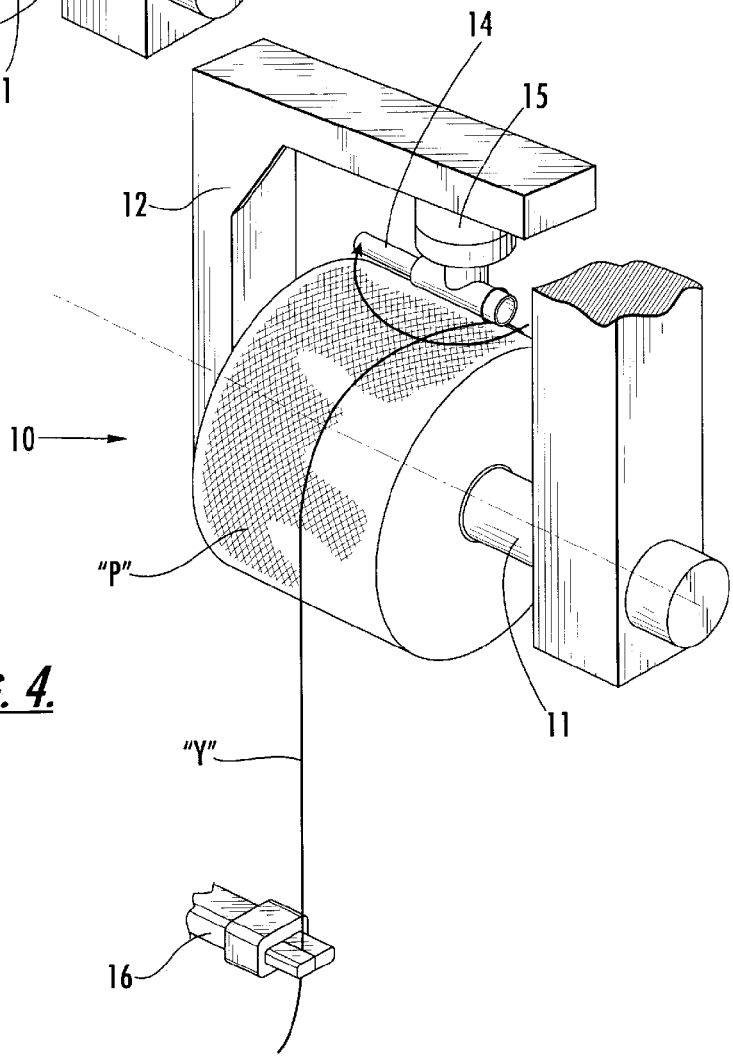

Referring now to FIGS. 3 and 4, shaft 15 is rotated 360 degrees to form a loop around the loop-forming tube 14 in the yarn "Y."

Figure 5:
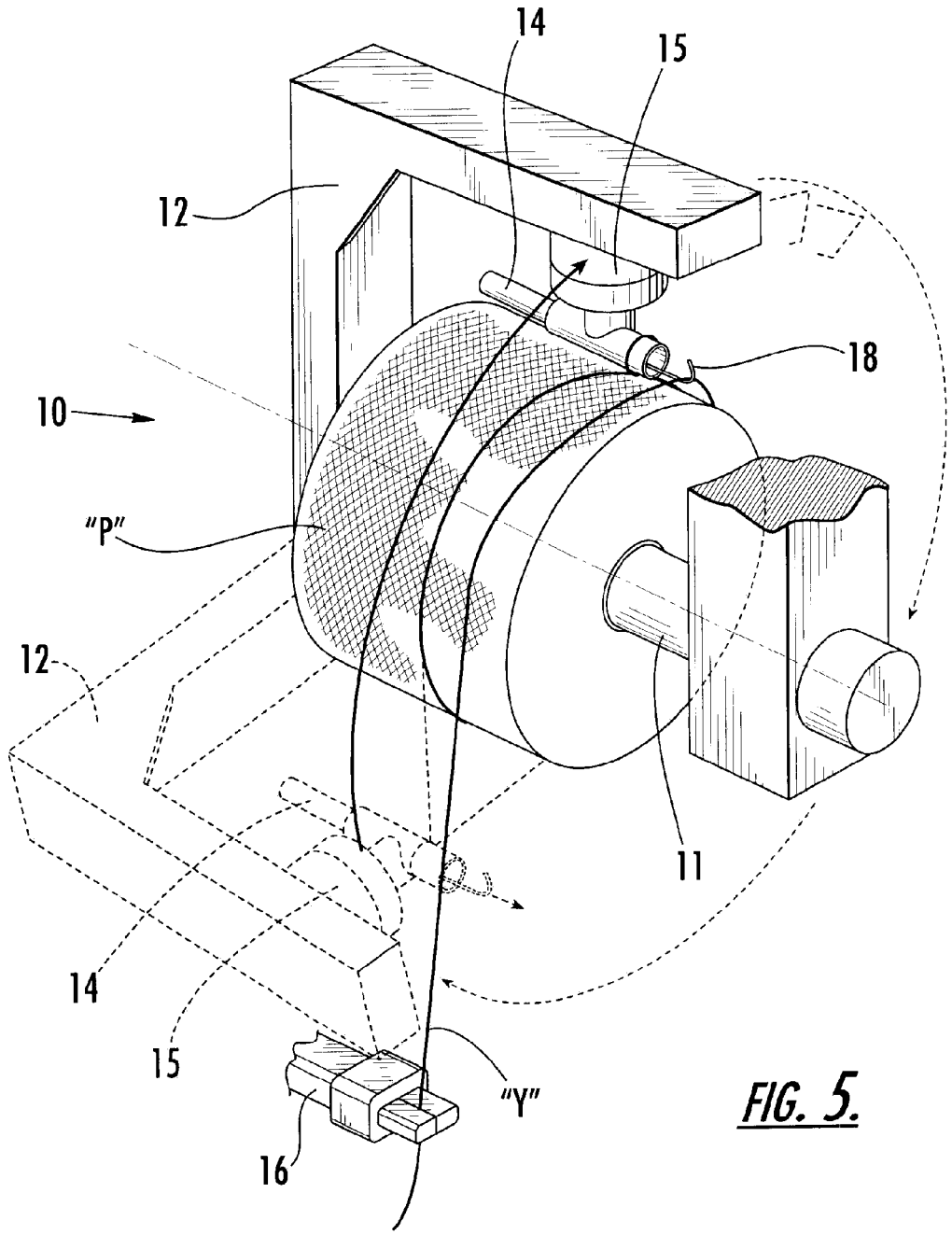

As is shown in FIG. 5, the swing arm 12 is rotated a further 360 degrees, while a hook 18 extends from the loop-forming tube 14 and catches the second pass of the yarn "Y." Note at this point the first loop formed by the swing arm 12 still resides over the loop-forming tube 14.

Figure 6:
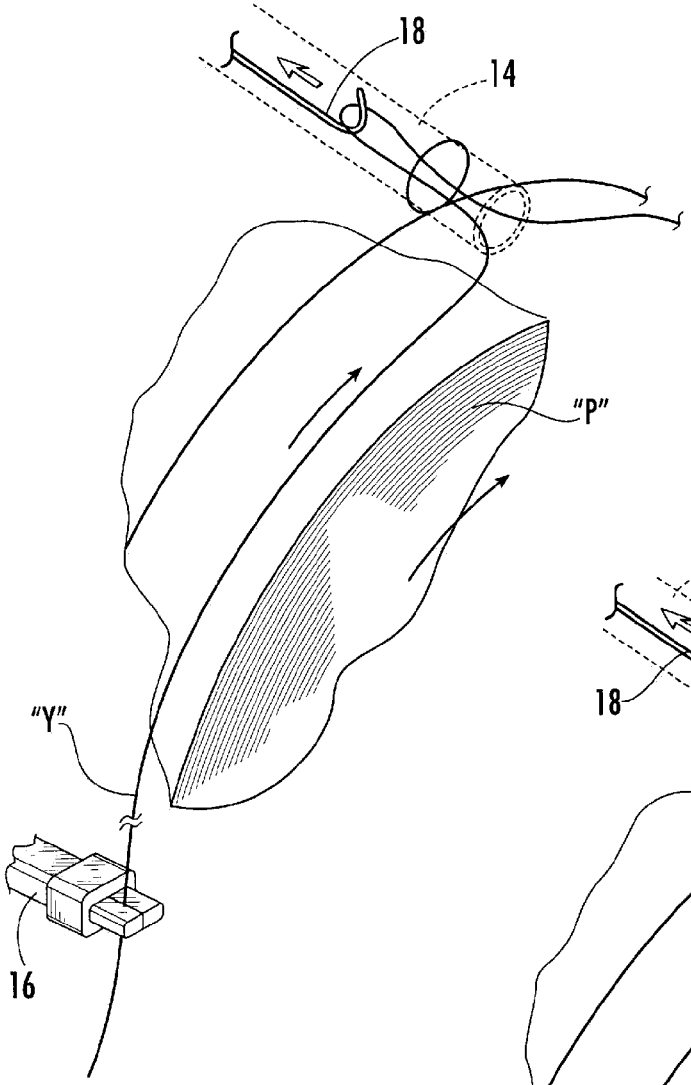
Figure 7:
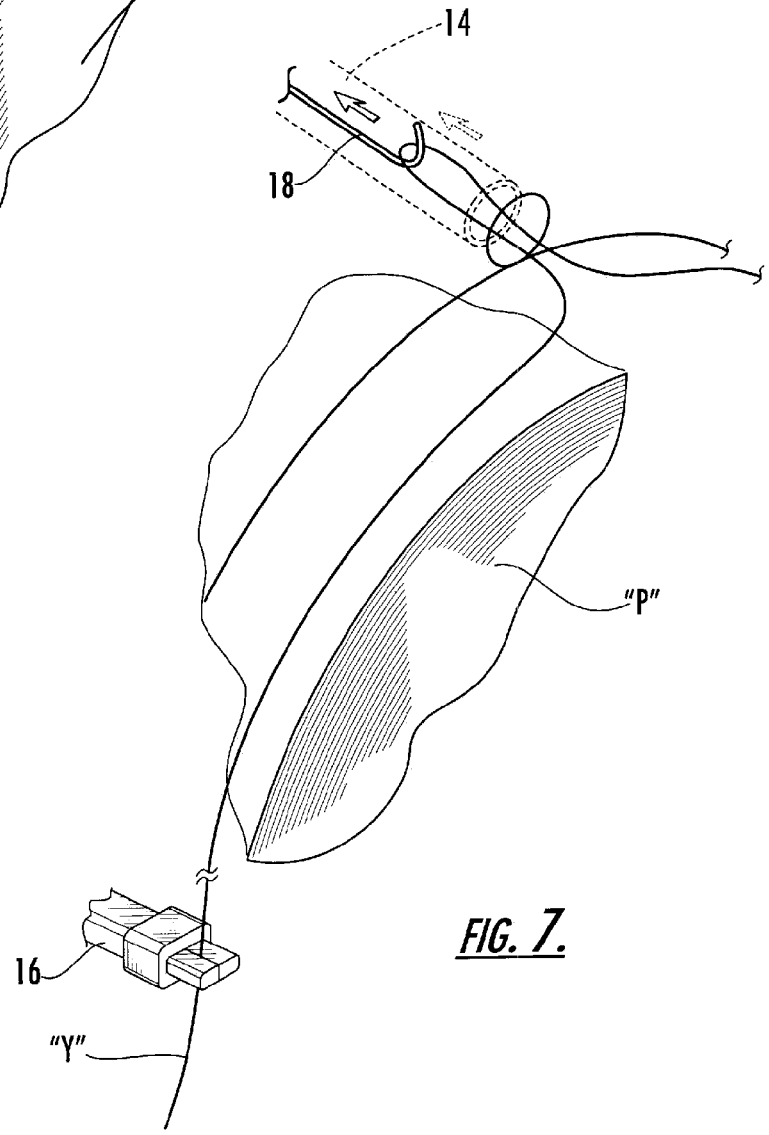

As is shown in FIG. 6, the hook 18 is withdrawn into the loop-forming tube 14, whereupon the loop-forming tube 14 itself is retracted, allowing the first loop formed by the swing arm 12 to slide off the end of the loop-forming tube 14 and across the neck of the loop drawn into the loop-forming tube 14 by the hook 18. See FIG. 7. As is also shown in FIG. 6, the package "P" is rotated in the unwind direction to provide sufficient slack in the yarn "Y" to permit the yarn "Y" to be pulled into the loop-forming tube 14.

Figure 8:
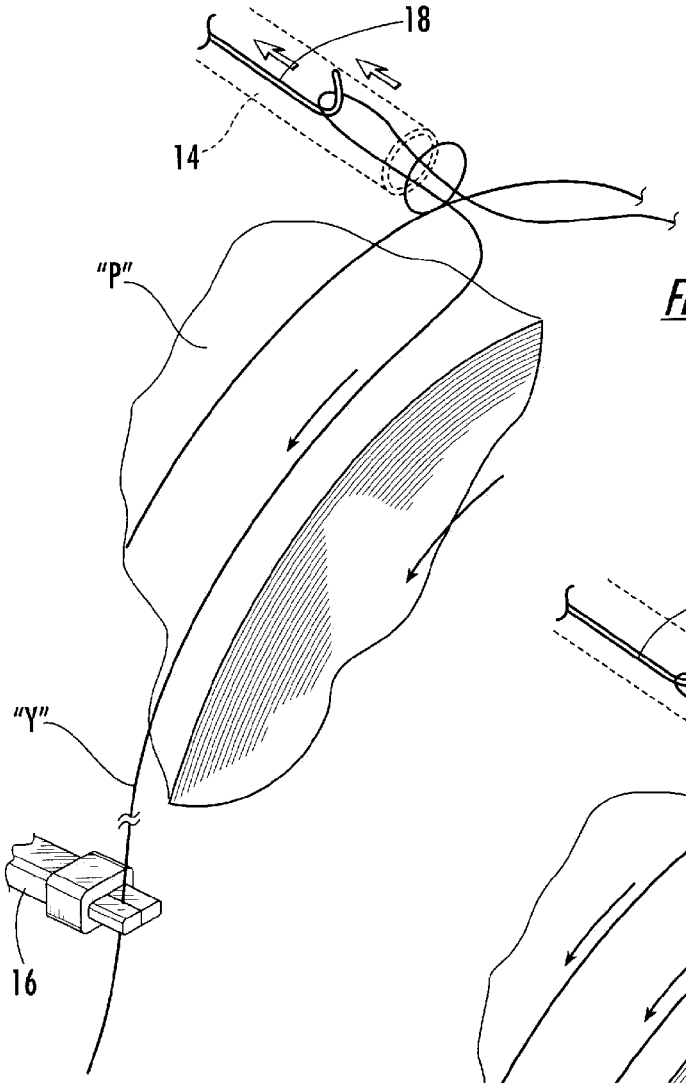
Figure 9:
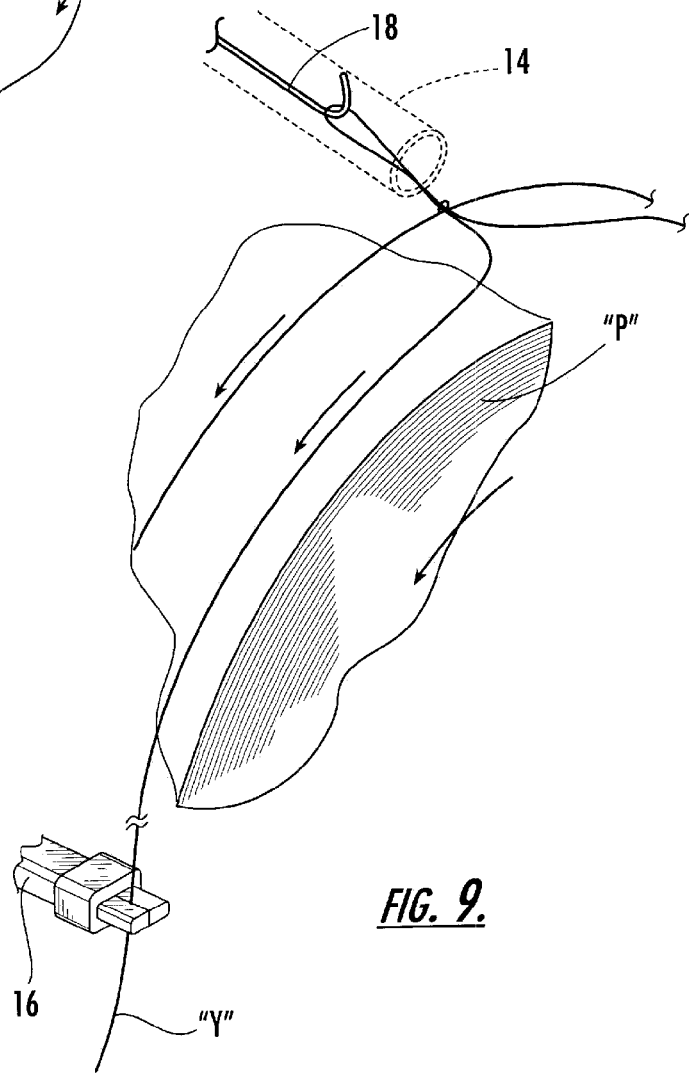
Figure 10:
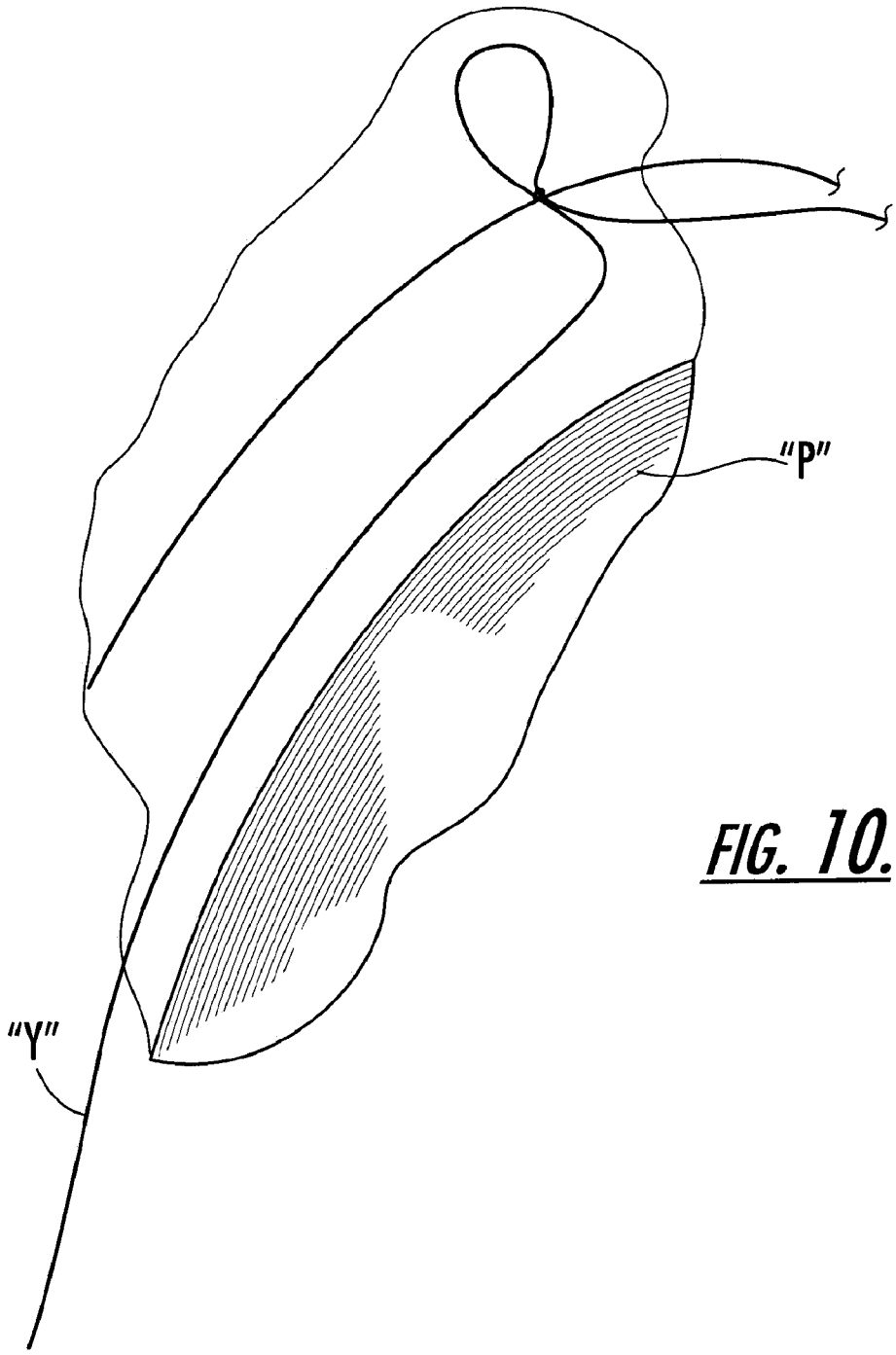
Figure 11:
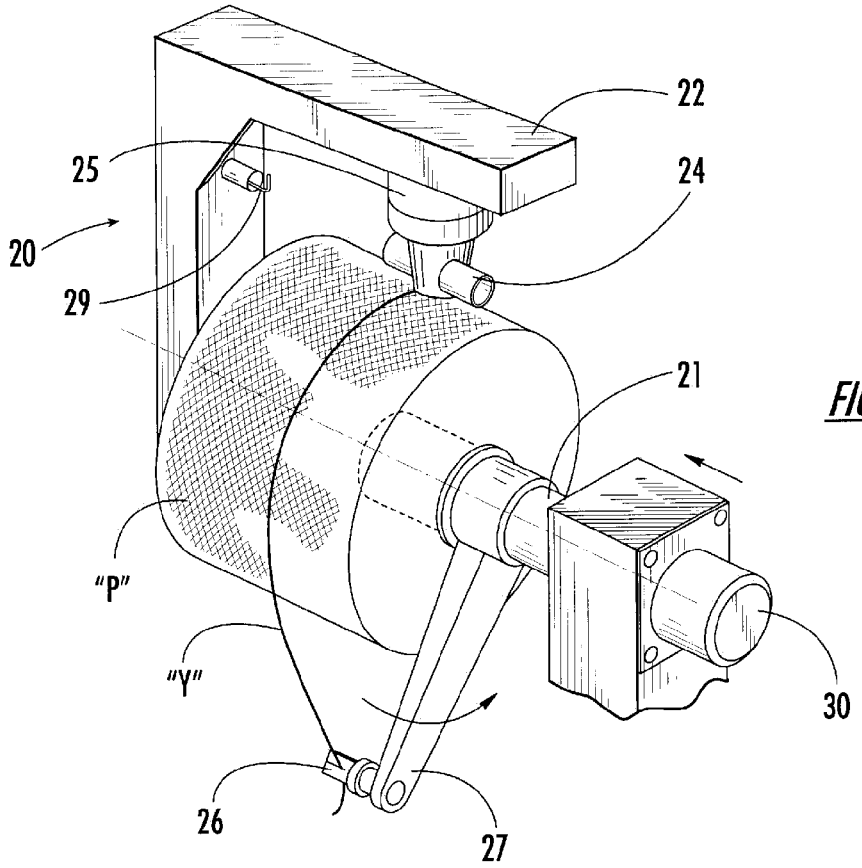
FIGS. 11-18 are sequential views of an automatic slip-knot tying machine according a second embodiment of the invention.

Referring now to FIGS. 8 and 9, the knot is tightened by rotating the package "P" in the wind direction sufficiently to pull the loop tight around the length of yarn "Y" being retained in the loop-forming tube 14 by the hook 18. The hook 18 releases the yarn "Y" by rotating about its axis and the slip-knot is fully formed. See FIG. 10. The package "P" is rotated sufficiently to snug the yarn "Y" around the outside of the package "P" and then transported away from the automatic knot-tying machine 10.

It should be noted that any number of different mechanisms can be used to pull the yarn "Y" into the loop-forming tube 14. The hook 18 shown in the drawings is simply illustrative of several iterations, including a latch needle or a gripper similar to the gripper 16. The functional principle resides in the need to grip the yarn and pull it through the loop formed on the loop-forming tube 14, and then to release the yarn "Y" at the appropriate time.

Another embodiment of the invention is shown in FIGS. 11-18, where an automatic knot-tying machine according to the present invention is illustrated and shown generally at reference numeral 20. As with automatic knot-tying machine 10, it is anticipated that automatic knot-tying machine 20 will be an attachment to textile winders and other machines where such knots are useful in preparing packages of yarn for transport to downstream processes.

The automatic knot-tying machine 20 includes a rotatable mandrel 21, such as an air chuck, on which the yarn package "P" is positioned. A stationary arm 22 is positioned adjacent the package "P", and carries a loop-forming tube 24. A gripper 26 mounted on the end of a rotating swing arm 27 holds the free end of yarn taut during knot formation. A servo-motor or motors 30 rotate both the swing arm 27 and the mandrel 21 on which the package "P" is positioned. From the starting position shown in FIG. 11, the swing arm 27 rotates around the package "P" and in doing so passes the yarn "Y" being by the gripper onto the loop-forming tube 24. The loop-forming tube 24 is mounted for rotation around a vertical axis on a shaft 25.

Figure 12:
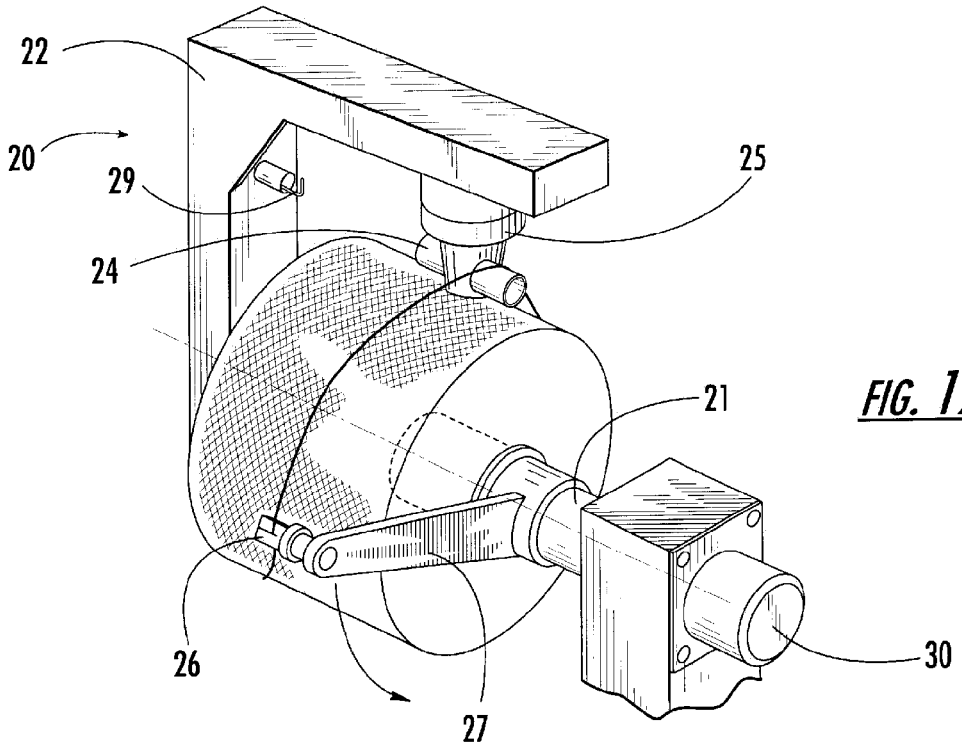

When the swing arm 27 reaches its starting position again, the yarn "Y" is looped around the package "P" and rests over the loop-forming tube 24. Yarn to form the loop is unwound off of the package "P" during rotation of the loop-forming 24. As is shown in FIG. 12, the package "P" and the swing arm rotate in the same direction during this step.

Figure 13:
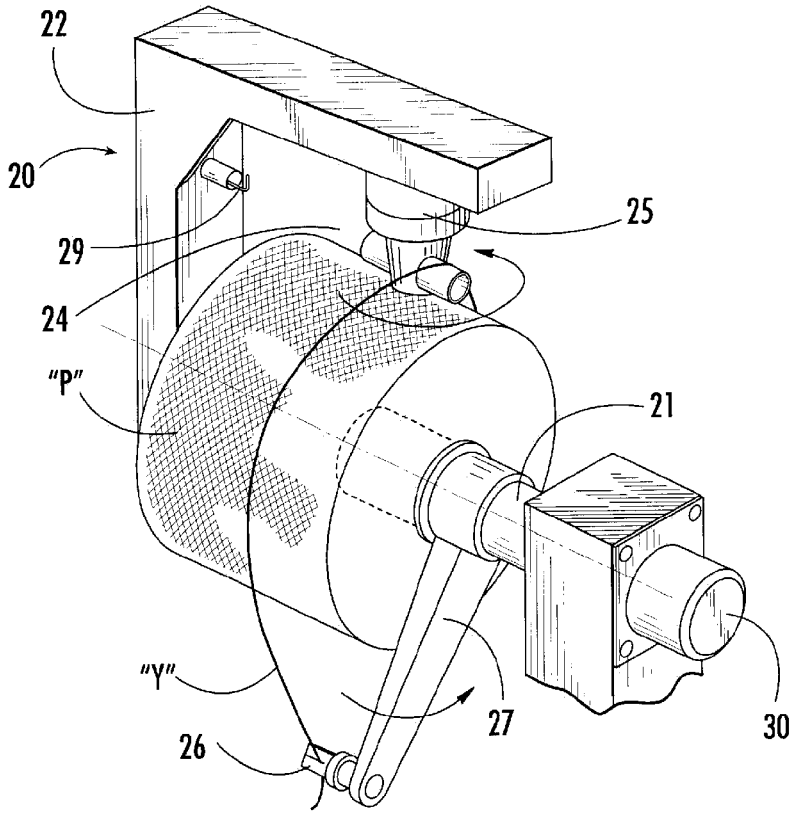
Figure 14:
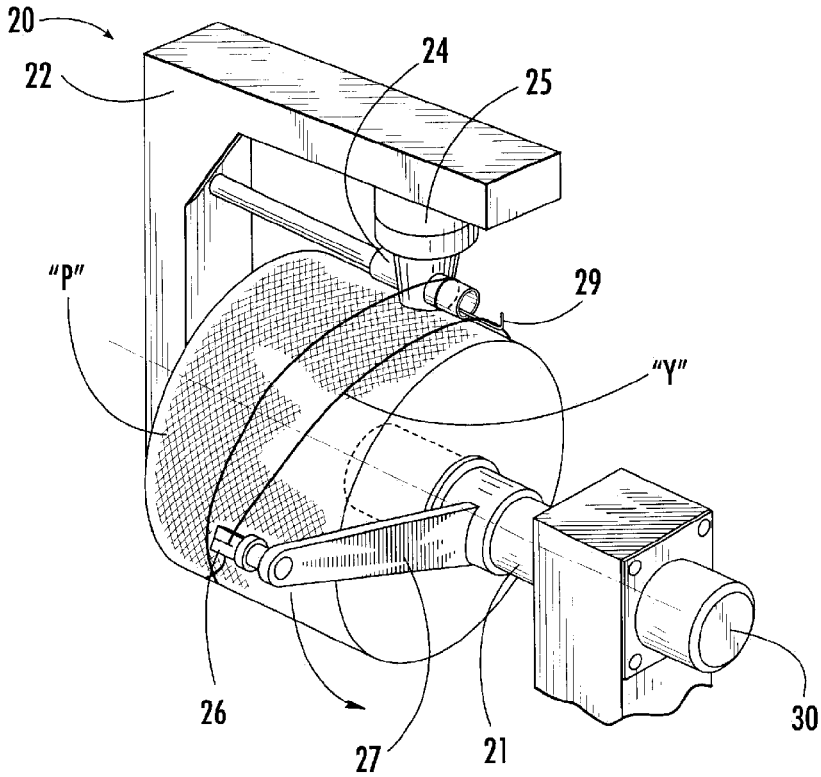

Referring now to FIGS. 13 and 14, shaft 25 is rotated 360 degrees to form a loop around the loop-forming tube 24 in the yarn "Y". A hook 29 carried by the stationary arm 22 extends outwardly into the loop-forming tube 24 and out the other end in preparation for a transfer to the hook.

Figure 15:
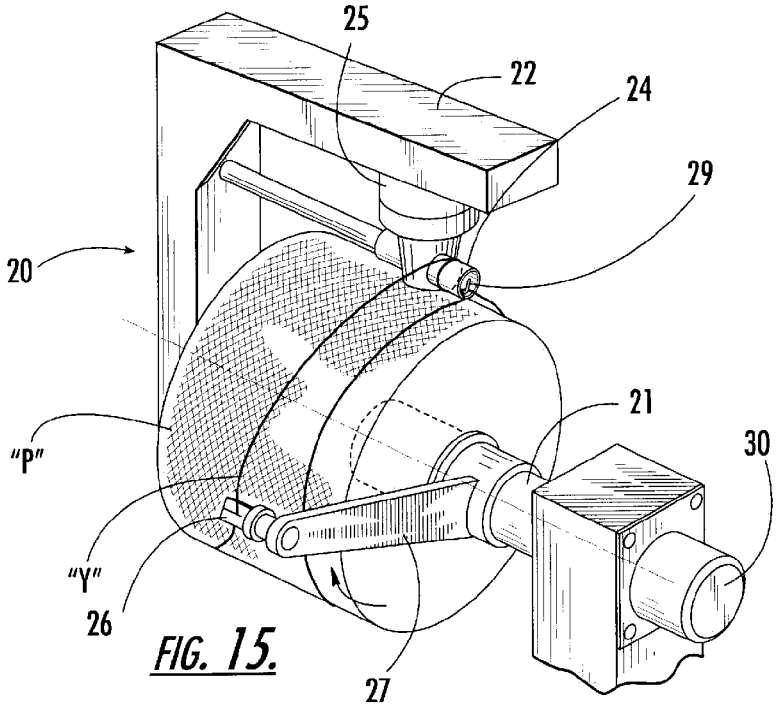
Figure 16:
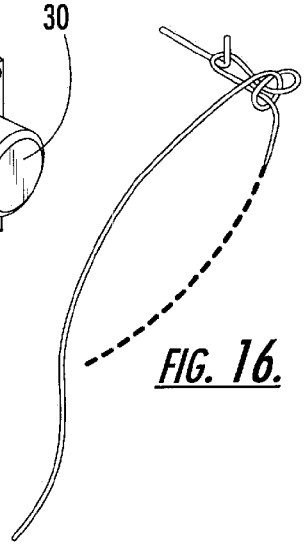

As is shown in FIGS. 14 and 15, the swing arm 27 is rotated a further 360 degrees, while the hook 29 extending outwardly from the loop-forming tube 24 catches the second pass of the yarn "Y". Note at this point the first loop formed by the swing arm 12 still resides over the loop-forming tube 24. As is shown in FIG. 16, the hook 29 with the yarn "Y" therein is withdrawn into the loop-forming tube 24. The swing arm 27 and the package "P" both rotate, the rotation of the package "P" giving back yarn sufficient to form the slip-knot.

The loop-forming tube 14 itself is then retracted, allowing the first loop formed by the swing arm 27 to slide off the end of the loop-forming tube 24 and across the neck of the loop drawn into the loop-forming tube 24 by the hook 29. See FIGS. 16 and 17.

Figure 17:
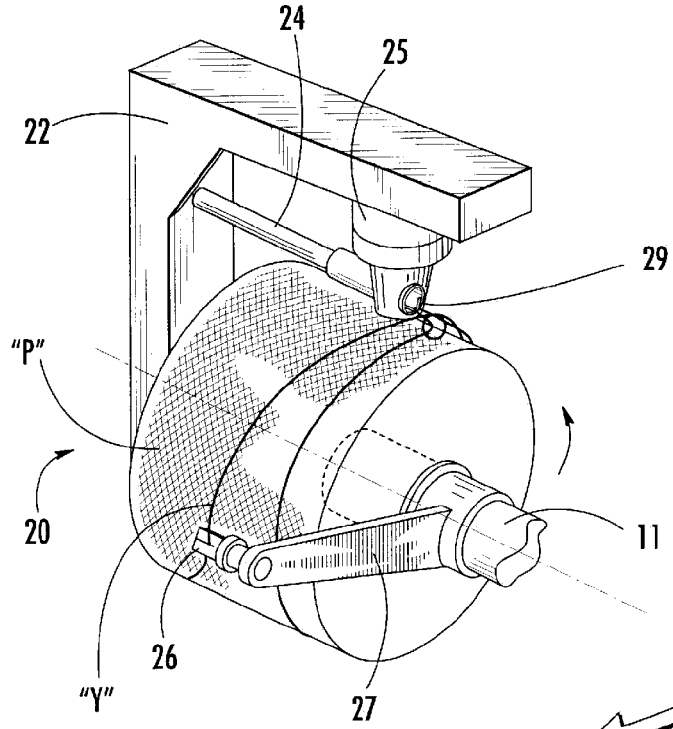
Figure 18:
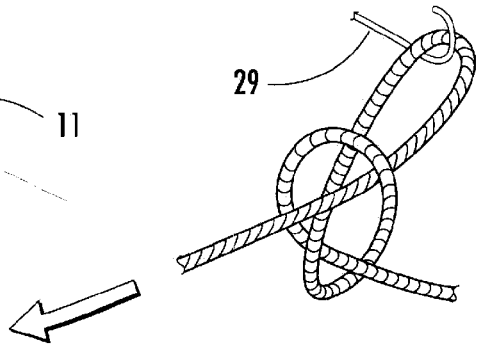
Figure 19:
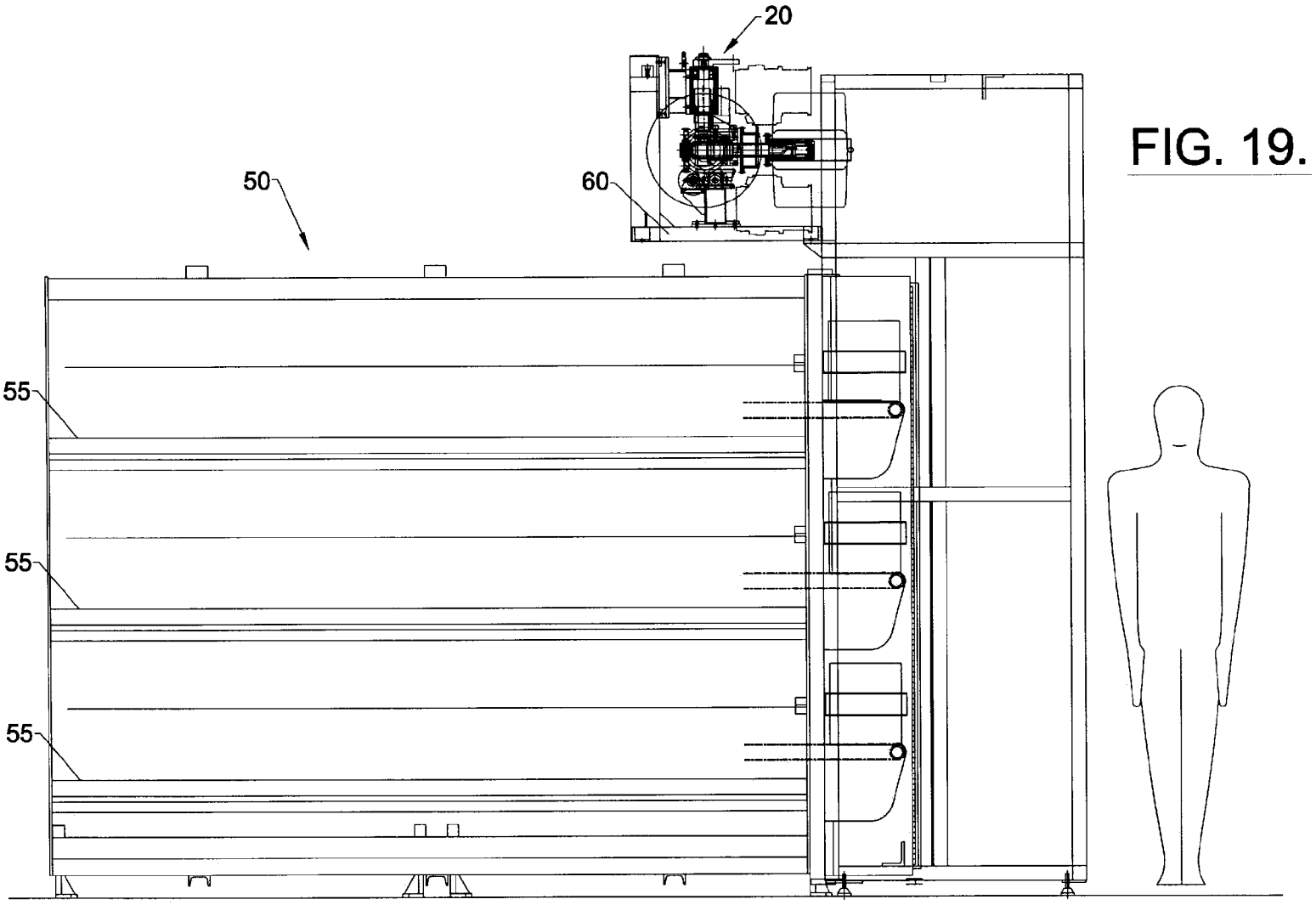
FIG. 19 is a front schematic elevation of a winder, showing the package knotter and related assemblies positioned on top of the winder.
Figure 20:
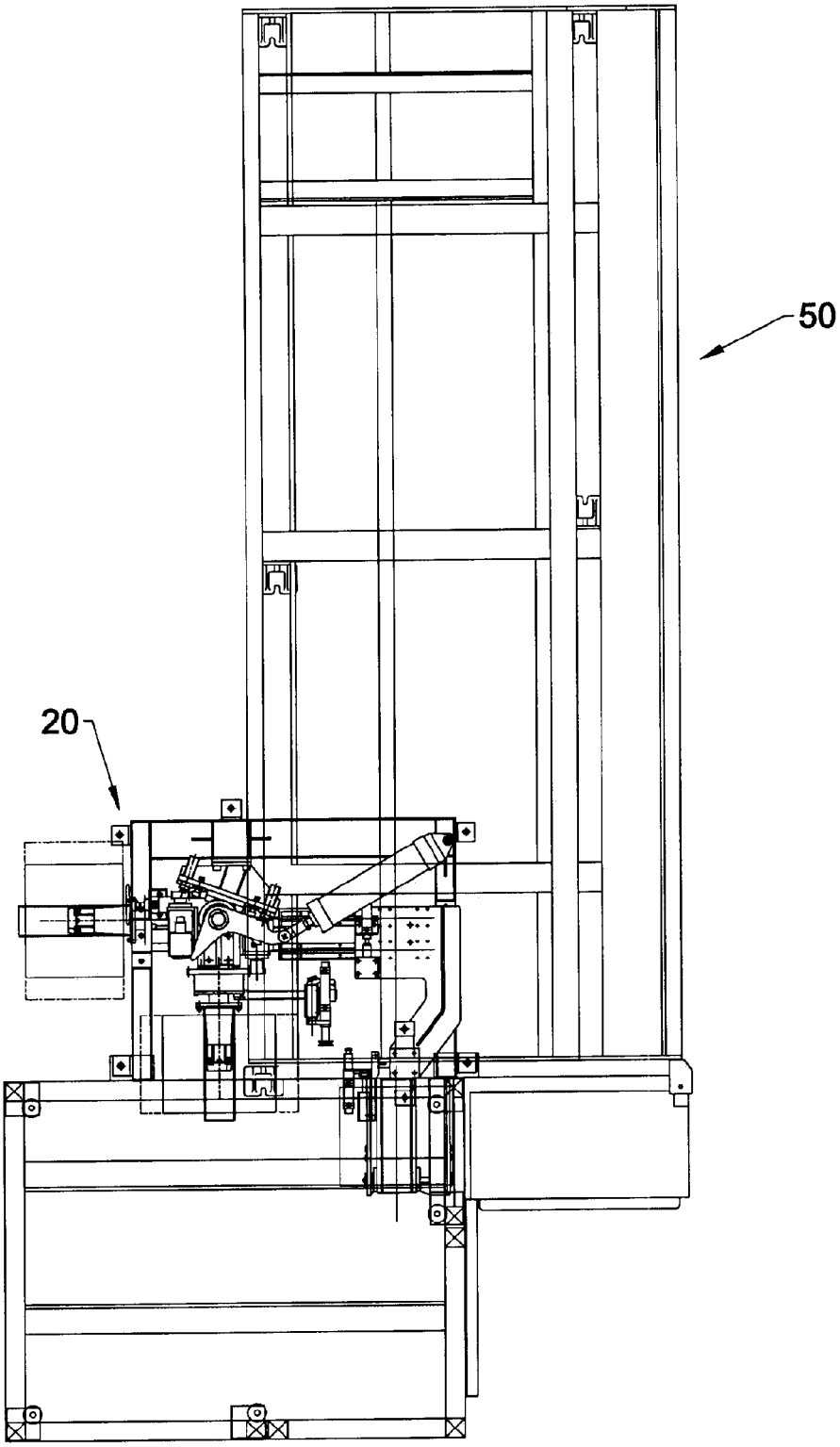
FIG. 20 is a top plan schematic view of the winder and package knotter shown in FIG. 19.
Figure 21:
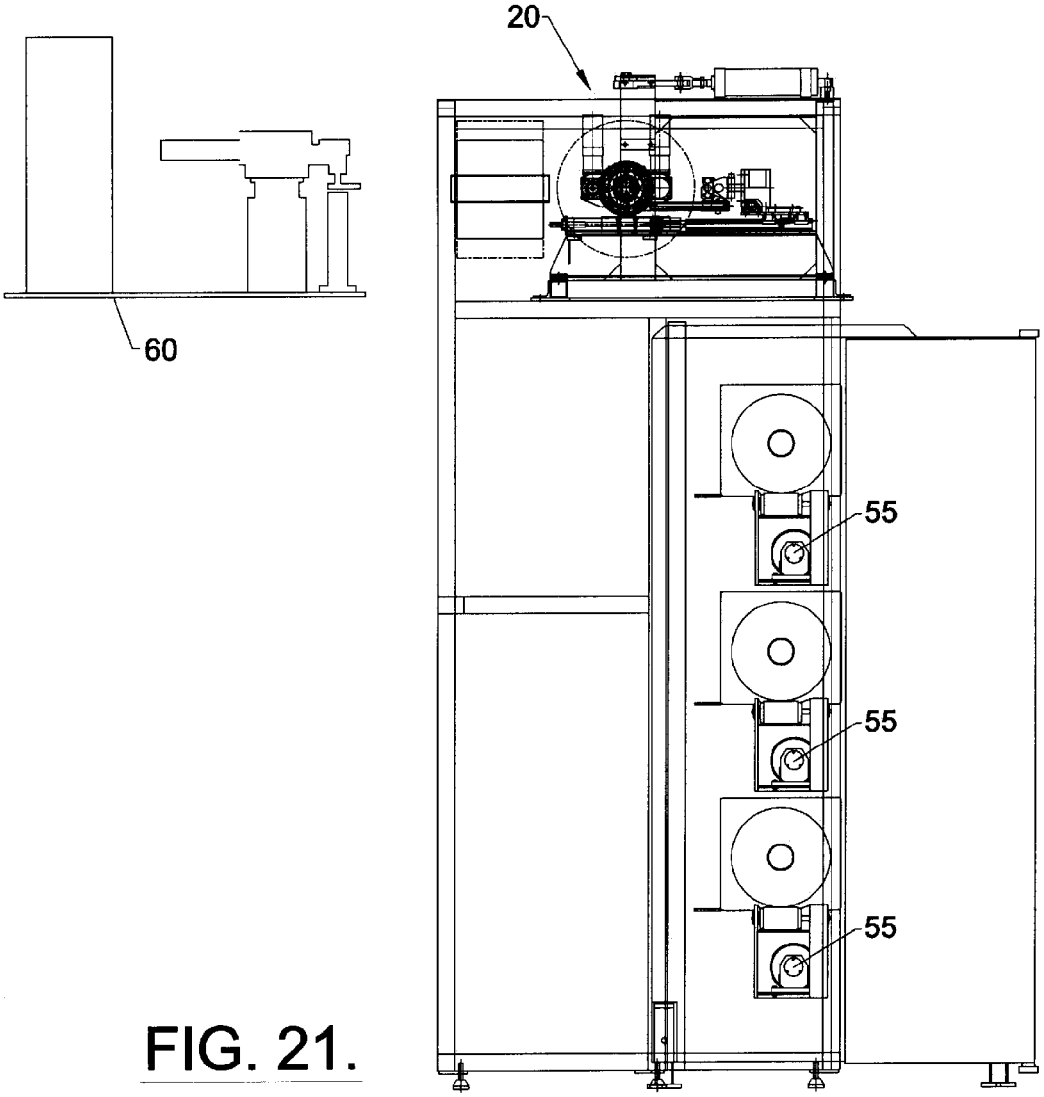
FIG. 21 is an end schematic view of the winder and package knotter shown in FIG. 19.
Figure 22:
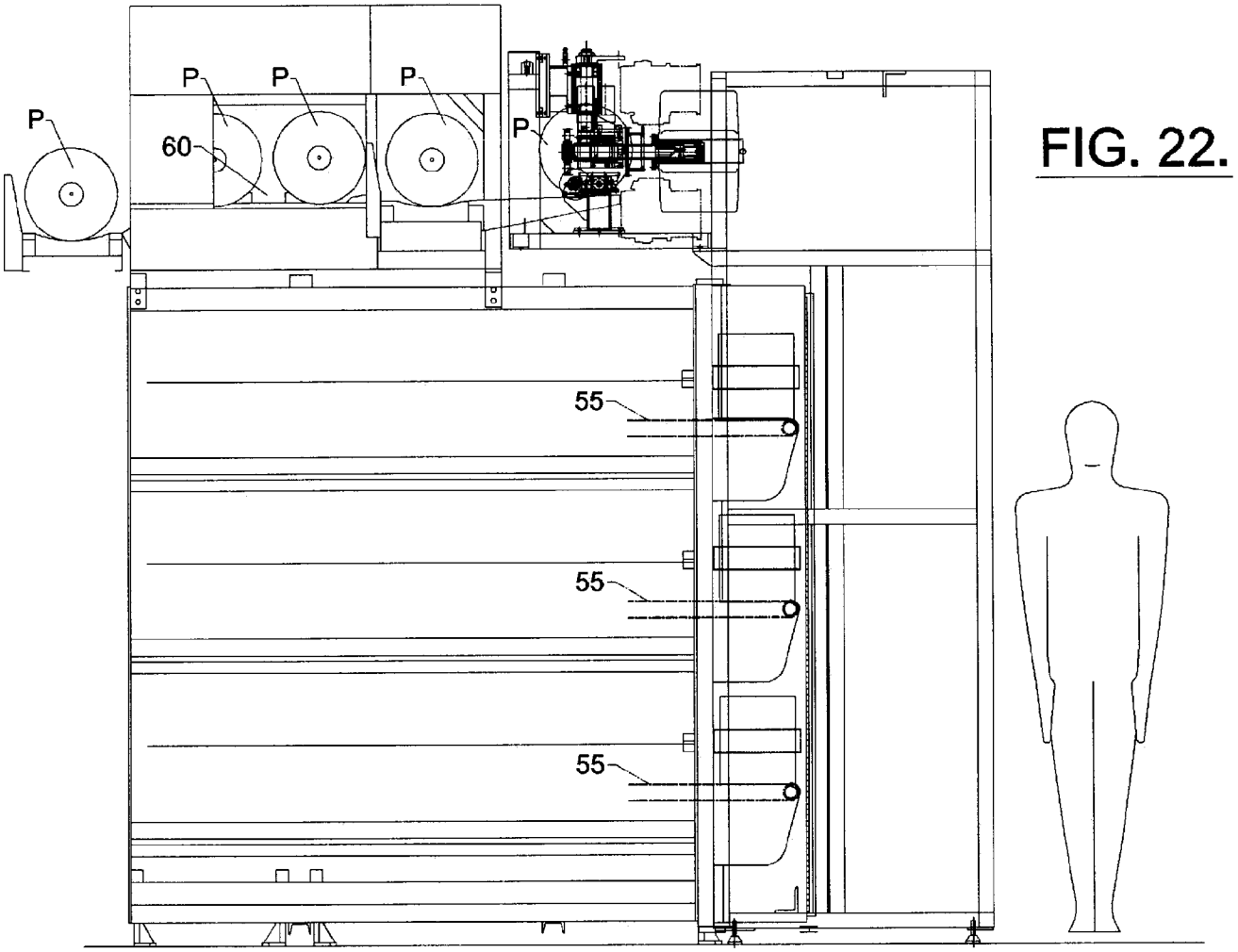
FIG. 22 is a front elevation of a shortened prototype winder showing the package knotter and the package conveyer from the package knotter to the packing station.

Referring now to FIGS. 17 and 18, the knot is tightened by rotating the package "P" in the wind direction sufficiently to pull the loop tight around the length of yarn "Y" being retained in the loop-forming tube by the hook 29. The hook 29 releases the yarn "Y" and the slip-knot is fully formed. See FIG. 18. The package "P" is rotated sufficiently to snug the yarn "Y" around the outside of the package "P". The package "P" is then transported away from the automatic knot-tying machine 20.

In both embodiments, the knot is released and the yarn tail made available for being tied to another end of yarn merely by grasping the free end and pulling gently.

After insertion of the knot, the package is rotated 90 degrees and a label is inserted into the interior of the package. One such suitable labeling machine is sold under the trademark "Pneu Touch" and made by PTI, Inc. Aspects of this device are disclosed in U.S. Pat. Nos. 5,435,862 and 5,540,795.

Referring now to FIGS. 19-22, the knot-tying machine 20 is shown in place on a winder, generally identified at reference numeral 50, which may be any type of textile winder, for example, those manufactured by applicant and used principally for processing carpet yarn. Winder 50 winds yarn onto a plurality of packages, for example 24, during a single winding phase, after which the packages are doffed, and new, empty packages are donned and the winding process begins again. After doffing, the packages are conveyed on a conveyor assembly 55 to one end of the winder 50, where they are conveyed upwardly to the knot-tying machine 20, which is mounted above the top level of the winder 50. The packages "P" are donned onto the mandrel 21 one at a time and the knotting process described above is carried out. Each package "P" is then doffed from the mandrel 21 and conveyed downstream on a conveyor 60 to a holding station where an entire case of packages "P" is accumulated. Sec FIG. 22.

Then, the entire case of packages is sent at one time to packing. The entire process is sufficiently rapid that the knotter can process an entire doff of, for example, 36 to 48 packages, while yarn is being wound onto the next batch of packages. In practice, a production rate for the process as described has been developed in the range of 20 to 25 seconds per knotting and packing cycle.

In the time since the patents referenced above were issued, yarn processing technology has progressed such that winding operations now produce wound packages in quantities up to 96 packages per doff. The increase in package count per doff significantly reduces the time span available between doffs to knot and pack the packages. The time between doffs is also affected by increasing package yardage count (which increases doff times) and increasing winding yardage speeds (which decreases doff times), but overall doff times have not impacted available processing time between doffs to the degree that increased package count has. While the existing knotting process technology remains valid, the cycle time of all processes as described above needs to be reduced in order to knot and pack up to 96 packages within the time span available between machine doffs. This necessary time reduction is achieved by dividing the process steps described above into a sequence of independent operations to be coordinated through PLC logic control and a conveyor arrangement to move a package from one operation in the sequence of processes to the next.

At least two distinct means of conveying packages from station to station through the sequential process are envisioned. The first iteration is a conveying system to carry the packages through the process by supporting the packages on spindles to minimize the process time consumed by detecting package centers on a piece-by-piece basis. The spindles, incorporated into a shuttle framework, have individual control to engage/disengage a spindle to form a package independent of the other spindles, allowing for optimization of cycle times for any of the described process system station functions.

The second iteration is a "bucket or carrier" method that requires a means to compensate for differences in package diameter, and may include visual sensing to correct for variations in package diameter. Such an approach may simplify the mechanical design of the system for the benefits of reduced system cost and complexity. This approach also allows the package position to remain on a common line throughout processing, and will not require lateral space to "home" a retracted spindle within the system mechanical layout, offering opportunities for more compact system footprint as a benefit for incorporation of the knotting system into an existing winding and pack out arrangement with minimal disruption and re-arrangement of existing pack out machinery.

Figure 23:
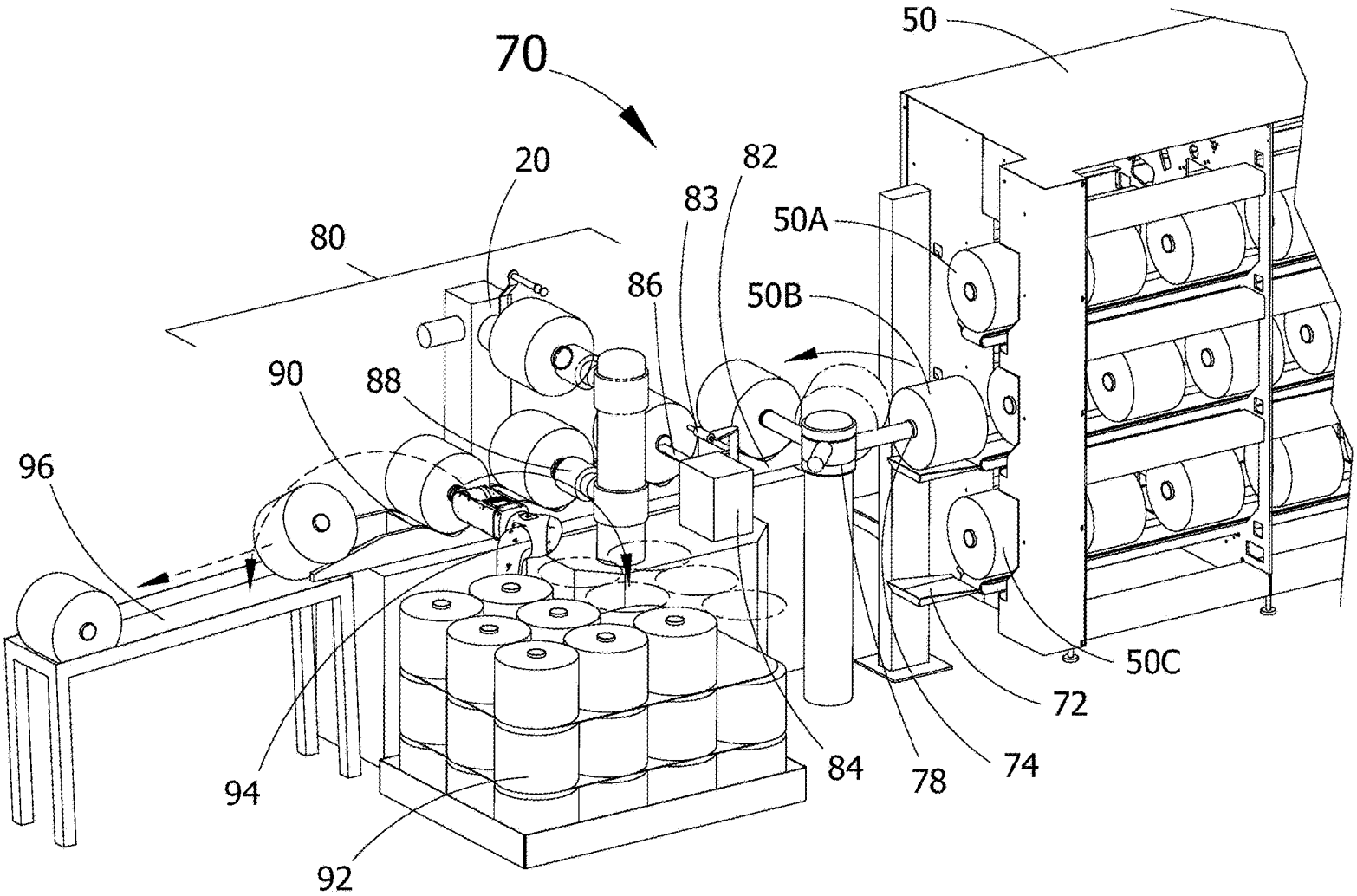
FIG. 23 is an overall perspective view of the automatic yarn package handling system that incorporates the automatic slip-knot tying machine according to one embodiment of the invention.

Referring to FIG. 23, in accordance with a first embodiment of the invention, an automatic yarn package handling system 70 is shown as an integral part of the winder 50 and includes the knotter 20 generally as described in detail above. However, details of the transfer system and related system elements described below vary in non-material aspects from the above description.

The winder elevator tray 72 brings a yarn package P, in this example, a tubular yarn package, from any of multiple winder levels 50A, 50B, 50C to a common transfer location. A pneumatically controlled spindle 74 of a package transfer mechanism 78 is inserted into and securely holds the yarn package P. The yarn package P is lifted from the winder elevator tray 72, rotated to the location of an indexing conveyor tray 82 of the indexing conveyor 80, and lowered into the indexing conveyor tray 82. The spindle 74 retracts from the tube of the package P, then rotates in the opposite direction to a home position and awaits a signal to transfer the next package P from the winder elevator 72. The indexing conveyor 80 then indexes forward one position by means of an intermittent motion drive system, e.g. a walking beam mechanism or a ratcheting drive arrangement.

A visual mark is placed upon the package outer surface through direct contact between the package and a marking apparatus 83 as the package translates from its initial conveyor position to the next. The mark is typically of a non-permanent nature (e.g. chalk), so that the mark is completely removed from the package fibers through downstream processing. This mark visually conveys production information pertaining to that package to a viewer at a glance.

Package information is coded at a coding station 84 where package marking takes place and an adhesive identifying label is printed from an integral printer head then dispensed to an arm 86 positioned to extend into the package P. The label is applied to the inside surface of the package P and the conveyor 80 then indexes forward one position.

In addition to adhesive label package coding, alternate methods can be incorporated into the coding process. Application of markings will likely be performed on or inside the package tube, to avoid any permanent marking of the yarn product. Examples of alternate methods include direct printing onto the package, and laser-based marking of the package.

A pneumatically-controlled mandrel 88 is inserted into the package P, lifting it from its conveyor tray 82 to the knotting head apparatus 20 which ties a slip knot to secure the package tail and prevent it from unraveling in subsequent package handling as described in detail above. The knot is inspected via mechanical and/or visual method to verify its integrity. A failed knot is noted and tracked through a PLC-based registry memory to signal the system to reject a failed package P negating any further automated processing.

The package P is then lowered back to the conveyor tray 82. The conveyor 80 then indexes forward one position to a discharge position 90.

This conveyor position 90 is the common location for interfacing with further automation processes provided by other system elements. As disclosed by way of example in this application, the acceptable package P is transferred from the conveyor tray 82 into a package case matrix 92 by a programmable collaborative robot device 94, for example, an articulating transfer arm. The collaborative robot device 94 will take no action if the package P is flagged as a failed package. The conveyor tray 82 indexes forward one position with the failed package remaining on the conveyor 80.

The failed package P is discharged from the conveyor 80 for manual rework through active or passive means. Active removal may utilize a robot cell or other mechanism to transfer the package P off of the conveyor 80 into a designated location or matrix 96.

A passive method of failed package discharge includes beginning the conveyor indexing motion with the conveyor tray 82 beneath the failed package ceasing to support the package P. Ramp forms in the conveyor 80 support the weight of the package P and allow it to slide or roll under force of gravity to an accumulation point, for example, a portable buggy. These packages P may also be collected on a flat work surface 96, as shown.

A novel feature of the automatic yarn package handling system 70 includes utilizing an automatic device for confirming whether or not the knot has actually been tied as intended. This can be done in a number of alternative ways, and the examples below do not exhaust the means by which this may be done, including processes developed in the future.

One method for determining whether the knot is tied is by monitoring torque to the yarn with, for example, a strain gauge or load cell. The absence of the required knot will result in a very low strain value returned by the gauge or cell, indicating that the yarn end is loose, rather than being held in the knot as required.

Another method is by use of optical machine vision to visually inspect the surface of the yarn package P to determine the presence or absence of the knot. An image of the package surface is captured and compared against a store of images representing the yarn arrangement indicative of a correctly-tied knot.

Other systems may be suitable as well, for example, a laser, ultrasound or other energy source to detect, measure and compare against a data store of surface irregularities on the package P indicative of the presence or absence of a knot.

In any case, an incorrectly tied or absent knot flags the package P as described above and discharges the package P from the system and transfers it to a rework collection location for manual knot tying.

Other features include provision of the time constraint required for current production rates and the development of the multi-station process to overcome this shortcoming of the existing knot tying system technology.

The act of marking each package with a visual marker as is now done manually by the operator. Currently, a chalk stick mark is applied directly to the fibers of the package to visually differentiate each package as to its production lot, or perhaps from which winder it was generated. A benefit of stick chalk is its availability in a wide variety of colors. In one embodiment of the invention, a chalk stick will be positioned to contact and leave a mark on a package as it translates from one station of the process to the next station.

The elevator 72 will locate the center of the package to provide an accurate and consistent location to begin the transfer of the package from the winder 50 to the knotting system apparatus 70. This is in contrast to the existing system that simply moves packages vertically to a designated elevation, without regard for the location of the center of the package, which will vary depending on package overall diameter.

A pick and place apparatus, which includes an arm 86, transfers the package through 3-axis translation and rotational motions from the winder 50 to one or more predetermined locations.

Figure 24:
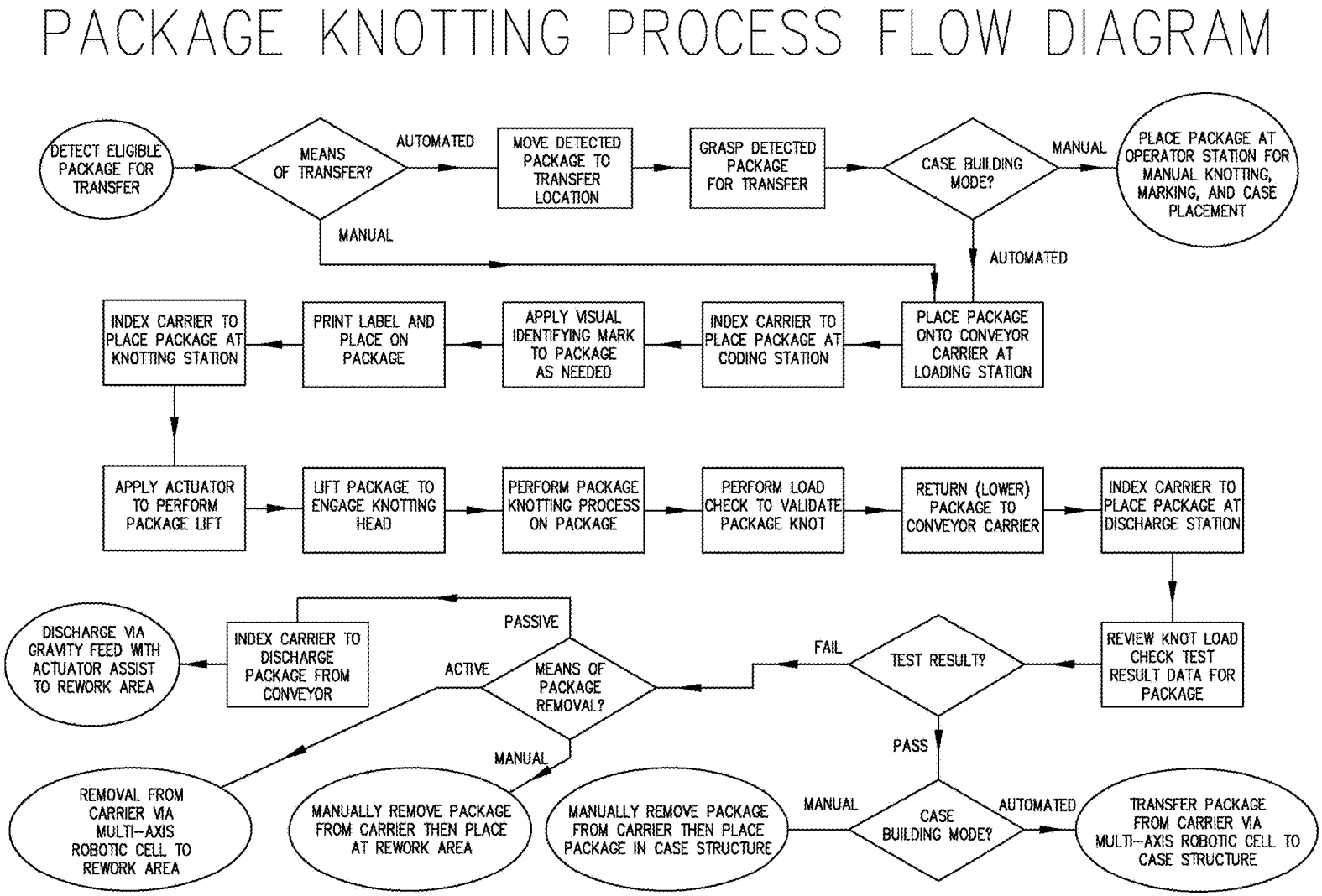
FIG. 24 is a flow diagram illustrating the functions of the automatic yarn package handling system for the embodiment of the system as described in FIG. 23.

Referring now to FIG. 24, a detailed flow method diagram for the above-described package knotting process is shown. The process begins with detecting a package eligible for transfer. A decision is made to determine whether the processing can be carried out automatically or whether the package must be diverted to a location for manual marking, labeling, knotting and case placement. If the package is initially determined to be suitable for automated processing, the package proceeds through a series of steps where the package is marked, a label printed and applied, and forwarded to a knotting head where a knot is applied to the tail end of the yarn on the package.

To determine whether the knot has been properly applied, the package is examined using one of the processes described above, i.e., use of a strain gauge or load cell, machine vision or another of the processes outlined. If the package "passes", i.e. a properly-tied knot is detected, the package is delivered to a case building location where a case-size grouping of packages, for example, 36 packages, 3×4 on three levels, is formed for insertion into a protective case. If the package fails the "knot" test, it is diverted to a rework area for manual correction. This diversion may be passive, active or manual.

Figure 25:
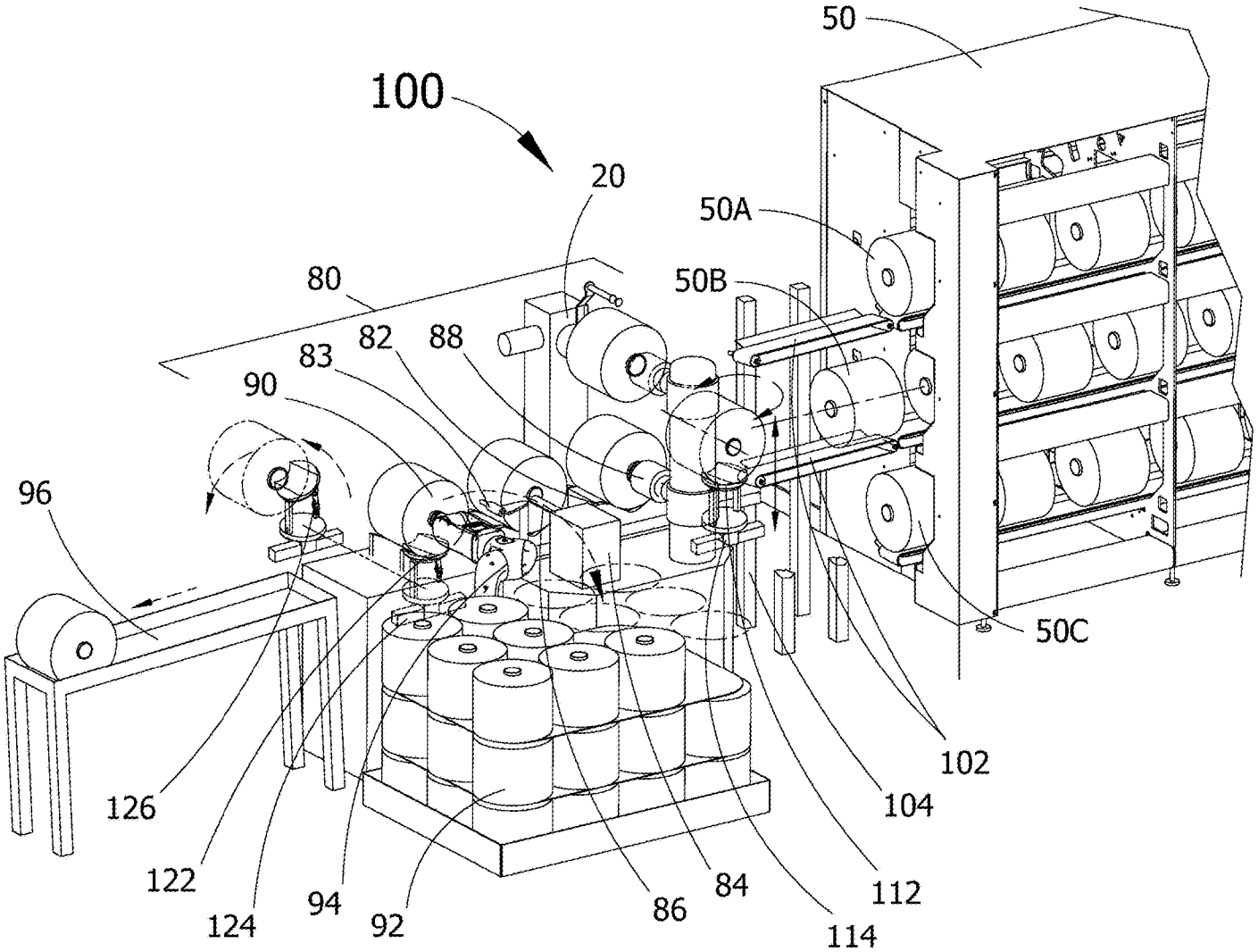
FIG. 25 is an overall perspective view of the automatic yarn package handling system that incorporates the automatic slip-knot tying machine according to another embodiment of the invention.
Figure 26:
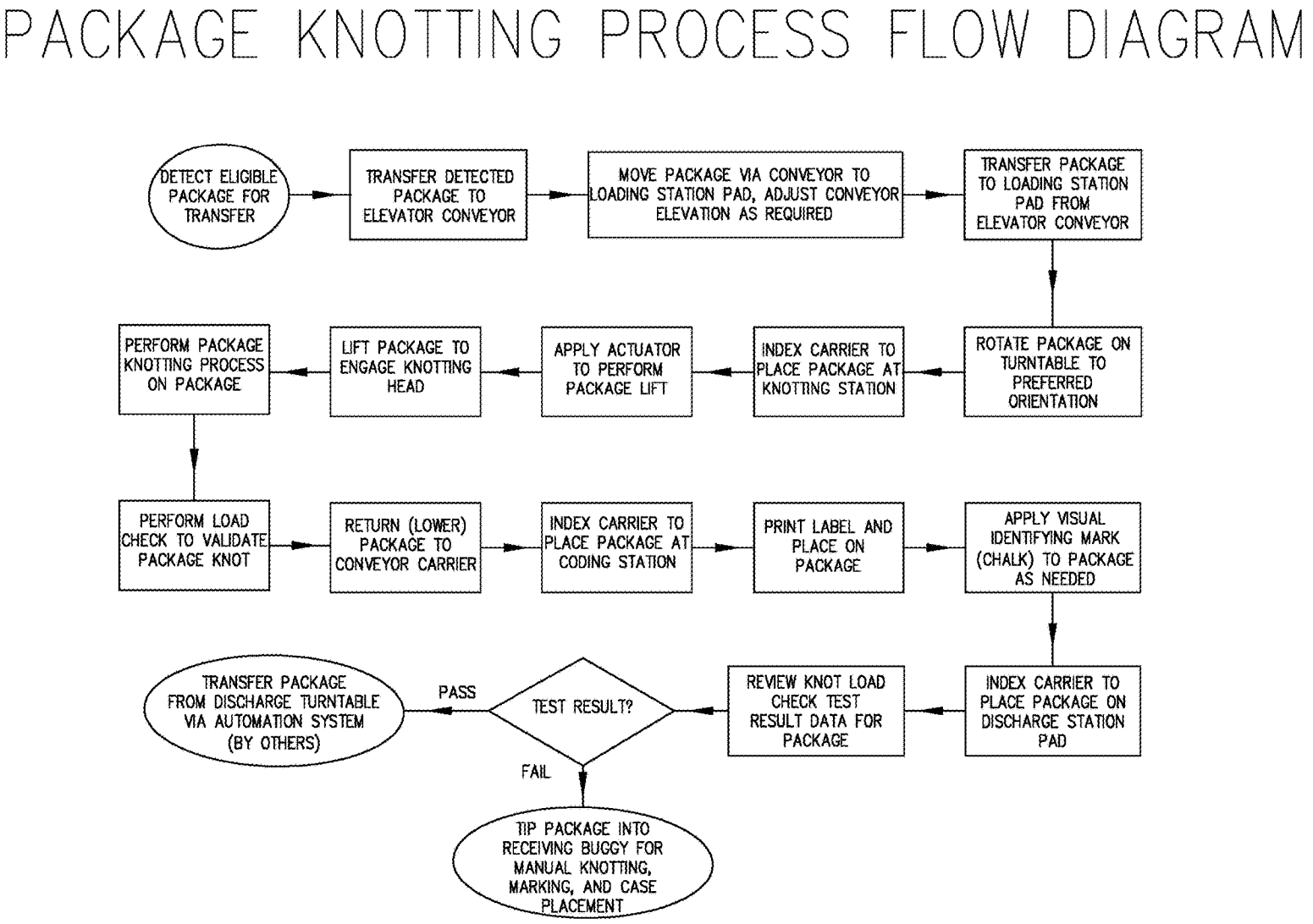
FIG. 26 is a flow diagram illustrating the functions of the automatic yarn package handling system for the embodiment of the system as described in FIG. 25.

Another embodiment of the invention performs the described knotting and marking actions while transporting the finished yarn package with reference to the yarn package outside diameter. Referring now to FIG. 25, an automatic yarn package handling system 100 is shown as an integral part of the winder 50 and includes the knotter 20 generally as described in detail above.

The elevator conveyor 102 brings a yarn package P, for example, a tubular yarn package, from any of multiple winder levels 50A, 50B, 50C to a common transfer location. The winder conveyor belt is activated to transfer package P to the elevator conveyor belt which then carries the package P the length of the elevator conveyor to transfer the package onto loading station pad 112 at the loading position of indexing conveyor 80. During the conveyor transfer the elevator conveyor frame 104 raises or lowers its elevation as necessary to access the loading station pad 112. Upon placement of package P at the loading station pad 112, a confirmation signal is sent to release the elevator conveyor 102 to initiate transfer of the next package P from one of winder levels 50A, 50B, 50C.

The package P is initially positioned upon the loading station pad 112 with the longitudinal axis of its package tube aligned with an axis in the general direction of package P translation as package P is transferred through the system. This directional axis is preferably aligned common with the centerline of the winder conveyor(s). However, the longitudinal axis of package P must be oriented perpendicular to the conveyor center line axis to perform the knotting and labeling actions. Loading station pad 112 has the facility to rotate at least 90 degrees in either rotational direction from its initial orientation by rotary actuator 114, which can deliver torque to loading station pad 112 by means of pneumatic, servo or other means of power generation. Upon completion of the rotation action, the indexing conveyor 80 then indexes package P forward one position to the knotting position by means of an intermittent motion drive system, e.g. a walking beam mechanism or a ratcheting drive arrangement.

A pneumatically-controlled mandrel 88 is inserted into the package P, lifting it from its conveyor tray 82 to the knotting head apparatus 20 which ties a slip knot to secure the package tail and prevent it from unraveling in subsequent package handling as described in detail above. The knot is inspected via mechanical and/or visual method to verify its integrity. A failed knot is noted and tracked through a PLC-based registry memory to signal the system to reject a failed package P negating any further automated processing. The package P is then lowered back to the conveyor tray 82. The conveyor 80 then indexes forward one position to a coding position.

Package information is coded at a coding station 84 where package marking takes place and an adhesive identifying label is printed from an integral printer head then dispensed to an arm 86 positioned to extend into the package P. The label is applied to the inside surface of the package P and the conveyor 80 then indexes forward one position moving the package P to the discharge position 90.

A visual mark is placed upon the package outer surface through direct contact between the package and a marking apparatus 83 as the package translates from the coding position to the discharge position 90. The mark is typically of a non-permanent nature (e.g. chalk), so that the mark is completely removed from the package fibers through downstream processing. This mark visually conveys production information pertaining to that package to a viewer at a glance.

The conveyor discharge position 90 is the common location for interfacing with further automation processes provided by other system elements. As disclosed by way of example in this application, the acceptable package P is transferred from the conveyor tray 82 into a package case matrix 92 by a programmable collaborative robot device 94, for example, an articulating transfer arm. The collaborative robot device 94 will take no action if the package P is flagged as a failed package.

The discharge position 90 of the indexing conveyor 80 features a discharge station pad 122 with similar rotation capabilities as described for the loading station pad 112 and including a rotary actuator 124 to provide torque for rotation of the package P placed upon the discharge station pad 122. The discharge station pad 122 also has the capability to tip package P in a desired direction onto a work surface 96 for further processing of the package if necessary. The tipping action is achieved by a pivoting actuator 126 that is energized pneumatically upon a signal that the package P is not eligible to be placed automatically into the package case matrix 92 as described in the previous paragraph.

Alternately, the passive or active means of rejected package removal from the automated pack out process as described in the previous embodiment of the invention and illustrated in FIG. 23 can also be applied in this embodiment.

An automatic knot-tying machine and process are described above. Various details of the invention may be changed without departing from its scope. Furthermore, the foregoing description of the preferred embodiment of the invention and the best mode practicing the invention are provided for the purpose of illustration only and not for the purpose of limitation.

We claim:

1. An apparatus for robotically tying a knot, comprising:

a knotting head apparatus at a knot-tying location for tying a knot to a yarn tail of a yarn package to secure the yarn tail from unraveling in subsequent yarn package handling;

a digitally-controlled knot-validating apparatus for validating correct application of the knot to the yarn tail; and a yarn package indexer, wherein if the knot is validated as correctly applied, the yarn package indexer forwards the package to a case building location or, if the knot is not validated, the yarn package indexer forwards the package to a location for applying a correct knot to the yarn tail.

2. The apparatus according to claim 1, wherein the digitally-controlled knot-validating apparatus comprises an apparatus for monitoring torque to yarn indicating that a yarn end is loose, rather than being held in the knot.

3. The apparatus according to claim 2, wherein the knot-validating apparatus comprises an apparatus for sensing a strain value on the yarn tail indicating that the yarn end is loose, rather than being held in the knot.

4. The apparatus according to claim 3, wherein the knot-validating apparatus is adapted for sensing the presence or absence of the knot in the yarn and is selected from the group consisting of a strain gauge and a load cell.

5. The apparatus according to claim 1, wherein the digitally-controlled knot-validating apparatus comprises a visual inspecting apparatus adapted to inspect a surface of the yarn package to determine the presence or absence of the knot by capturing an image of the package surface and comparing the image of the package surface against a digital store of images representing a yarn arrangement indicative of a correctly-tied knot.

6. The apparatus according to claim 5, wherein the digitally-controlled knot-validating apparatus comprises a source of energy adapted to apply energy to the surface of the package to detect, measure and compare a returned energy signal against a digital data store of surface irregularities on the package indicative of the presence or absence of a knot.

7. The apparatus according to claim 6, wherein the energy source is selected from the group consisting of a laser and ultrasound.

8. The apparatus according to claim 1, wherein the yarn package indexer comprises an indexing conveyor including a rotatable discharge station pad for rotating the yarn package to the case building location or, if the knot is not validated, the yarn package indexer is adapted to forward the package to the location for applying a correct knot to the yarn tail.

9. The apparatus according to claim 8, wherein the rotatable discharge station pad includes a pivoting actuator adapted for tipping the yarn package in a desired direction onto a work surface for further processing of the yarn package.

10. The apparatus according to claim 9, further comprising a discharge conveyor defining a common location for interfacing with one or more automation apparatuses adapted to selectively transport a yarn package to a package case building location in the event of a correctly knotted yarn package, or to a knot-tying location for manual application of a knot to the yarn package in the event of an incorrectly knotted package.

11. A method of robotically tying a knot using the apparatus according to claim 1, the method comprising the steps of:

removing a package from a package transporter to a robotic knotting head apparatus at a knot-tying location;

robotically tying a knot to a yarn tail of the package to secure the yarn tail from unraveling in subsequent package handling; and robotically validating correct application of the knot to the yarn tail;

wherein the step of validating correct application of the knot to the yarn tail includes the step of monitoring torque to yarn.

12. The method according to claim 11, wherein the step of monitoring the torque to the yarn includes sensing a strain value on the yarn tail indicating that a yarn end is loose, rather than being held in the knot.

13. The method according to claim 12, wherein the step of monitoring the torque to the yarn includes utilizing a sensing device selected from the group consisting of a strain gauge and a load cell.

14. The method according to claim 13, wherein if the knot is validated as correctly applied, the method further comprises forwarding the package to a case building location or, if the knot is not validated, the method further comprises forwarding the package to a location for applying a correct knot to the yarn tail.

15. A method of robotically tying a knot using the apparatus according to claim 1, the method comprising the steps of:

removing a package from a package transporter to a robotic knotting head apparatus at a knot-tying location;

robotically tying a knot to a yarn tail of the package to secure the yarn tail from unraveling in subsequent package handling; and robotically validating correct application of the knot to the yarn tail;

wherein the step of validating correct application of the knot to the yarn tail includes the steps of visually inspecting a surface of the yarn package to determine the presence or absence of the knot by capturing an image of the package surface and comparing the image of the package surface against a digital store of images representing a yarn arrangement indicative of a correctly-tied knot.

16. The method according to claim 15, wherein the step of validating correct application of the knot to the yarn tail includes the steps of visually inspecting the surface of the yarn package to determine the presence or absence of the knot by digitally capturing the image of the package surface and comparing the image of the package surface against the digital store of images representing the yarn arrangement indicative of the correctly-tied knot.

17. The method according to claim 16, wherein if the knot is validated as correctly applied, the method further comprises forwarding the package to a case building location or, if the knot is not validated, the method further comprises forwarding the package to a location for applying a correct knot to the yarn tail.

18. A method of robotically tying a knot using the apparatus according to claim 1, the method comprising the steps of:

removing a package from a package transporter to a robotic knotting head apparatus at a knot-tying location;

robotically tying a knot to a yarn tail of the package to secure the yarn tail from unraveling in subsequent package handling; and robotically validating correct application of the knot to the yarn tail;

wherein the step of validating correct application of the knot to the yarn tail includes the steps of applying a source of energy to a surface of the package to detect, measure and compare a returned energy signal against a digital data store of surface irregularities on the package indicative of the presence or absence of a knot.

19. The method according to claim 18, wherein the step of validating correct application of the knot to the yarn tail includes the step of sensing the presence or absence of the knot in the yarn tail by utilizing the energy source selected from the group consisting of a laser and ultrasound.

20. The method according to claim 19, wherein if the knot is validated as correctly applied, the method further comprises forwarding the package to a case building location or, if the knot is not validated, the method further comprises forwarding the package to a location for applying a correct knot to the yarn tail.

* * * * *